US012342940B1

(12) United States Patent
Gibbons

(10) Patent No.: US 12,342,940 B1
(45) Date of Patent: Jul. 1, 2025

(54) CONTOURED SURFACE SUPPORT CUSHION

(71) Applicant: The Boppy Company, LLC, Golden, CO (US)

(72) Inventor: Haley Gibbons, Westminster, CO (US)

(73) Assignee: The Boppy Company, LLC, Golden, CO (US)

( * ) Notice: Subject to any disclaimer, the term of this patent is extended or adjusted under 35 U.S.C. 154(b) by 0 days.

(21) Appl. No.: 18/940,584

(22) Filed: Nov. 7, 2024

(51) Int. Cl.
*A47C 16/00* (2006.01)

(52) U.S. Cl.
CPC ..... *A47C 16/00* (2013.01)

(58) Field of Classification Search
CPC ..... A47C 16/00; A47C 7/383; A47C 7/38; A47D 13/083; A47D 13/08; A47G 9/10; A47G 9/1081; A47G 9/109; A47G 9/1072
See application file for complete search history.

(56) References Cited

U.S. PATENT DOCUMENTS 3,426,372 A * 2/1969 Enelow ..... A47G 9/10 5/636
5,109,557 A * 5/1992 Koy ..... A47D 13/083 5/655
5,790,999 A * 8/1998 Clark ..... A47D 13/083 5/655
8,321,977 B1 * 12/2012 Kummerfeld ..... A47D 13/083 5/636
8,661,587 B1 * 3/2014 Leach ..... A47D 13/08 5/655
2006/0162080 A1 * 7/2006 Littlehorn ..... A47D 13/083 5/655
2008/0250566 A1 * 10/2008 Brogan ..... A47G 9/10 5/645
2010/0175194 A1 * 7/2010 Mastrosimone-Gese ..... A47D 13/083 5/639
2013/0145556 A1 * 6/2013 Kummerfeld ..... A47D 13/083 5/655
2017/0099967 A1 * 4/2017 Holbrook ..... A47G 9/10

* cited by examiner

*Primary Examiner* — Justin C Mikowski
*Assistant Examiner* — Alison N Labarge
(74) *Attorney, Agent, or Firm* — Kilpatrick Townsend & Stockton LLP

(57) ABSTRACT

A support cushion includes a cushion body that includes fill material and an outer covering that encases the fill material. The cushion body has a first end, a second end, an outer peripheral edge, and an inner peripheral edge. The outer and inner peripheral edges have a generally arcuate shape between the first end and the second end. The cushion body defines a vertical axis about which the outer and inner peripheral edges curve. The cushion body tapers inward in a direction parallel to the vertical axis to define an arcuate depression in the cushion body that extends along a majority a length of the cushion body between the first and second ends.

21 Claims, 13 Drawing Sheets

CONTOURED SURFACE SUPPORT CUSHION

BACKGROUND

The embodiments herein relate generally to therapeutic support pillows. Many adults or adolescents participate in activities which make it desirable to support certain objects or body parts. For example, with activities such as reading, typing, breast feeding, bottle feeding, and the like, it is often desirable to support the arms or elbows. As another example, the therapeutic pillows may be used to support certain objects or body parts for gaming, knitting, and other activities.

Although some support structures have been proposed for supporting objects or body parts, such as the arms of a chair or certain braces, such structures are often uncomfortable and inconvenient to use. Further, some support structures are not easily portable, thereby limiting their use. In a further drawback, most support structures are designed only for a particular application and do not have multiple uses.

BRIEF DESCRIPTION

In one aspect, a support cushion includes a cushion body that includes fill material and a cover disposed about the fill material. The cushion body has a first end, a second end, an outer peripheral edge, and an inner peripheral edge. The outer peripheral edge and the inner peripheral edge of the cushion body have a generally arcuate shape between the first end and the second end and the cushion body defines a vertical axis about which the outer peripheral edge and the inner peripheral edge curve. The second end has a width in a direction orthogonal to the vertical axis that is smaller than a width of the first end. The cushion body tapers inward in a direction parallel to the vertical axis to define an arcuate depression in the cushion body that extends along a majority a length of the cushion body between the first end and the second end.

In some instances, an upper surface and a lower surface of the cushion body taper vertically inward such that the cushion body has a figure eight configuration. The inward taper of the upper surface and lower surface provides a gradual transition between a central portion of the cushion body and the first and second ends. The cushion body includes tapering means coupled with, or formed on, an inner surface of the cushion body. The tapering means may include a material that is coupled with the inner surface of the cushion body such that the material forms an inner wall within the cushion body. Alternatively, the tapering means may include one or more darting segments that are sewn into the inner surface of the cushion body.

The cushion body may include sufficient fill material disposed within the cover to provide the cushion body with a prescribed firmness where a force of at least 10 Newtons applied over at least 30 seconds is required to displace a 3-inch diameter hemispheric probe 1 inch into the cushion body. A decorative cover may be positioned over the cushion body. The decorative cover may have an opening that enables the cushion body to be inserted within an interior of the decorative covering and removed therefrom. The decorative cover may include a belt that is detachably coupleable with opposing sides of the decorative cover.

According to another aspect, a support cushion includes a cushion body having a first end and a second end. The cushion body has a generally arcuate shape between the first end and the second end and the cushion body defines a vertical axis about which the cushion body curves. The cushion body tapers inward in a direction parallel to the vertical axis and defines a depression in the cushion body that extends along a majority a length of the cushion body between the first end and the second end.

An upper surface and a lower surface of the cushion body may taper vertically inward such that the cushion body has a figure eight configuration. The inward taper of the upper surface and lower surface provides a gradual transition between a central portion of the cushion body and the first and second ends. The cushion body includes tapering means coupled with, or formed on, an inner surface of the cushion body. The tapering means may include a material that is coupled with the inner surface of the cushion body such that the material forms an inner wall within the cushion body. Alternatively, the tapering means may include one or more darting segments that are sewn into the inner surface of the cushion body.

The cushion body includes sufficient fill material to provide the cushion body with a prescribed firmness where a force of at least 10 Newtons applied over at least 30 seconds is required to displace a 3-inch diameter hemispheric probe 1 inch into the cushion body. In some instances, the support cushion also includes a decorative cover that is positioned over the cushion body. The decorative cover has an opening that enables the cushion body to be inserted within an interior of the decorative covering and removed therefrom. The decorative cover includes a belt that is detachably coupleable with opposing sides of the decorative cover.

According to another aspect, a method of forming a support cushion includes providing a cushion body having a first end and a second end. The cushion body also has a generally arcuate shape between the first end and the second end and defines a vertical axis about which the cushion body curves. The method also includes coupling or forming tapering means with an inner surface of the cushion body such that the tapering means extends along a majority a length of the cushion body between the first end and the second end. The method further includes stuffing the cushion body with cushioning material to form the support cushion.

The tapering means may be coupled with the inner surface of the cushion body such that an upper surface and a lower surface of the cushion body taper vertically inward. The cushioning material may be stuffed into the cushion body to provide the cushion body with a prescribed firmness where a force of at least 10 Newtons applied over at least 30 seconds is required to displace a 3-inch diameter hemispheric probe 1 inch into the cushion body. In some instances, the method may additionally include positioning a decorative cover over the cushion body. The decorative cover may have an opening that enables the cushion body to be inserted within an interior of the decorative covering and removed therefrom.

According to another aspect, a support cushion includes a cushion body having a medial region and two opposing arms that define an outer perimeter and a generally open well. The two opposing arms curve away from the medial region such that the cushion body has a roughly toroidal configuration that defines a vertical central axis. The medial region and/or at least one opposing arm taper inward in a direction parallel to the vertical central axis such that the cushion body is narrowed in the medial region and/or the at least one opposing arm. An upper surface and a lower surface of the medial region and/or the at least one opposing arm may taper vertically inward such that the medial region and/or the at least one opposing arm has a figure eight configuration. The inward taper of the upper surface and lower surface provides a gradual transition between the medial region and the opposing arms of the cushion body.

A width of the medial region, measured in a direction perpendicular to the vertical central axis, may be roughly equal to a width of each opposing arm measured in a direction perpendicular to the vertical central axis. The cushion body may include tapering means coupled with, or formed in, an inner surface of the cushion body along the medial region and/or the at least one opposing arm. The tapering means may be an hourglass shaped material that is coupled with the inner surface of the cushion body such that the hourglass shaped material forms an inner wall within the cushion body. The hourglass shaped material may include a plurality of separate material segments and/or one or more darting segments that are sewn into the inner surface of the cushion body along the medial region and/or the at least one opposing arm.

A cross-section profile of a non-narrowed portion of the cushion body may have a roughly circular or elliptical shape and/or a cross-section profile of the narrowed medial region and/or the at least one opposing arm may have a roughly dimpled or double torus shape. The double torus shape may be formed or defined by tapering means that are coupled with, or formed in, an inner surface of the medial region and/or the at least one opposing arm. Each opposing arm may have a thickness of between 5 and 8 inches and/or a thinnest portion of the medial region and/or the at least one opposing arm may have a thickness of between 1.5 and 4 inches.

The support cushion may also include a cover that is disposed about the cushion body. The cover may include an outer section that extends about the outer perimeter and a seamless inner section that is coupled to the outer section and extends about the open well. The seamless inner section may be adapted to prevent tearing of the cover adjacent an inner portion of the well upon separation of the arms. A central portion of the seamless inner section that is adjacent the medial region of the cushion body may taper inward such that the central portion of the seamless inner section is thinner than opposing sides of the seamless inner section immediately adjacent to the central portion.

According to another aspect, a support cushion includes a cushion body having a medial region and two opposing arms that define an outer perimeter and a generally open well. The arms are separable from each other and are configured to move toward one another after the arms have been separated and released. The cushion body includes a fill material and a cover disposed about the fill material. The cover includes an outer section that extends about the outer perimeter and a seamless inner section that is coupled to the outer section and extends about the open well. The seamless inner section is adapted to prevent tearing of the cover material adjacent an inner portion of the well upon separation of the arms. A portion of the seamless inner section that is adjacent the medial region of the cushion body, or at least one opposing arm, tapers inward such that the portion of the seamless inner section is narrowed between opposing sides of the seamless inner section immediately adjacent to the narrowed portion.

According to another aspect, a support cushion includes a cushion body having a medial region and two opposing arms that define an outer perimeter and a generally open well. The medial region, or at least one opposing arm, includes two opposing major surfaces. The cushion body includes a fill material and a cover that is disposed about the fill material. The two opposing major surfaces include a dipped region where the two opposing surfaces dip toward each other. The support cushion may also include a connector that is operably coupled to the two opposing major surfaces at the dipped region. The connector causes the two major surfaces to dip toward each other.

According to another aspect, a method of forming a support cushion includes providing a cushion body having a medial region and two opposing arms and coupling or forming tapering means with an inner surface of the cushion body along the medial region of the cushion body and/or along at least one opposing arm. The method also includes stuffing the cushion body with cushioning material to form the support cushion. The cushion body defines an outer perimeter and a generally open well and the two opposing arms curve away from the medial region such that the cushion body has a roughly toroidal configuration that defines a vertical central axis. A thickness of the medial region and/or the at least one opposing arm, measured in a direction parallel to the vertical central axis, is thinner (via the tapering means) than a thickness of each arm that does not include the tapering means.

In some instances, the method further includes positioning a cover about the cushion body. The cover includes an outer section that extends about the outer perimeter and a seamless inner section that is coupled to the outer section and that extends about the open well. The seamless inner section is adapted to prevent tearing of the cover adjacent an inner portion of the well upon separation of the arms. A portion of the seamless inner section that is adjacent the medial region of the cushion body and/or the at least one opposing arm tapers inward such that the portion of the seamless inner section is thinner than opposing sides of the seamless inner section immediately adjacent to the thinner portion.

BRIEF DESCRIPTION OF THE DRAWINGS

The present invention is described in conjunction with the appended figures.

Figure 1:
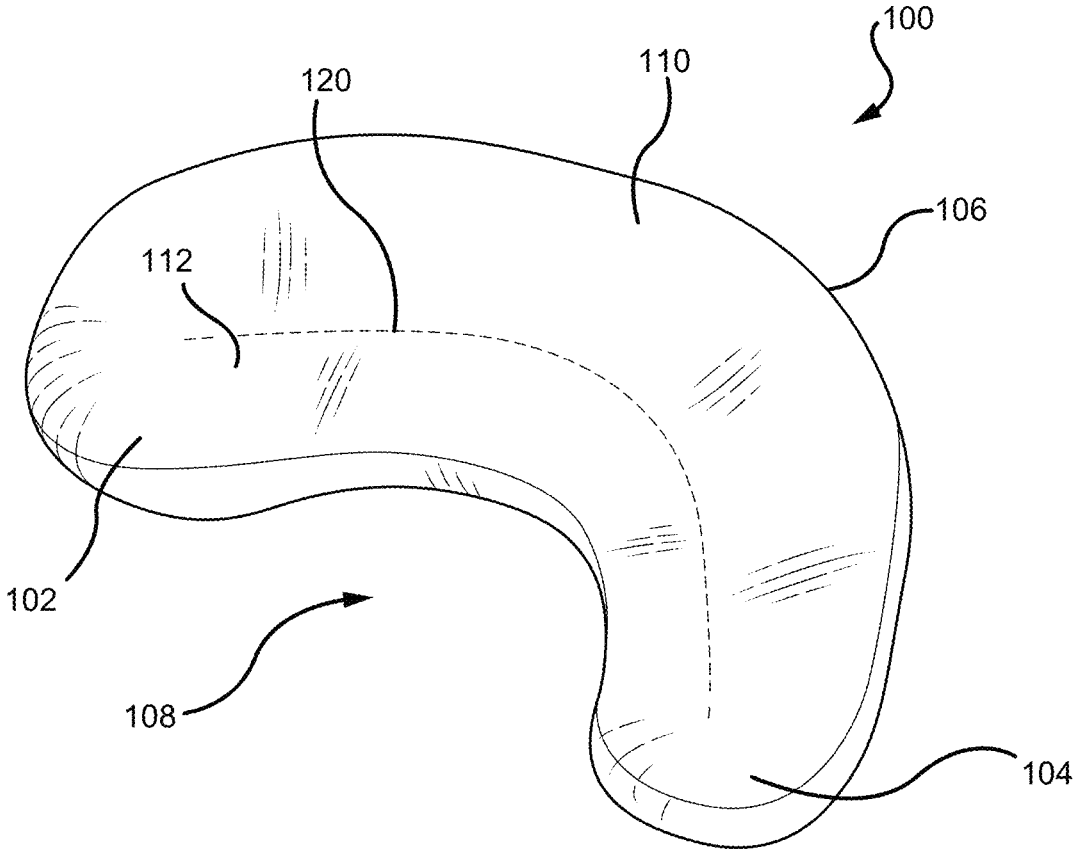
FIG. 1 is a perspective view of a first embodiment of a contoured surface support cushion.
Figure 2:
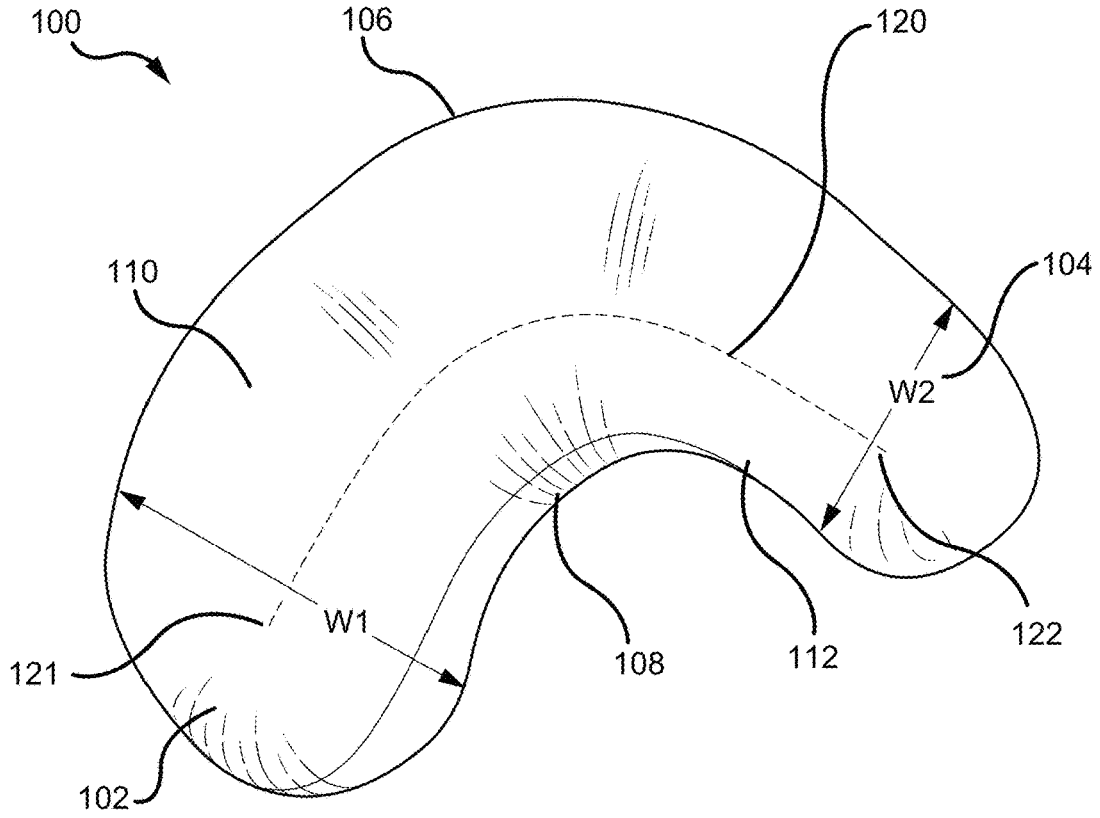
FIGS. 2-3 are top view of the contoured surface support cushion of FIG. 1.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

Embodiments disclosed herein generally relate to support cushions and methods of forming support cushions. The support cushion is contoured to provide added support and comfort for an infant or young child that is cared for by a parent or guardian and/or for a parent or guardian that is feeding or caring for the child. For example, an angle of the contoured support cushion may be designed to allow the parent or guardian to more easily feed an infant or young child that is lying on, or sitting on, the support cushion. The support cushion may have one or more flat surfaces that support the infant or child during feeding. In some instances, a loft of the support cushion may be reduced in comparison with conventional cushions.

In some embodiments, the contoured support cushion includes a cushion body that has an inward taper that defines a depression in the cushion body. The inward taper may extend along a majority of a length of the cushion body or may extend only along a portion of the cushion body. In one instance, the cushion body includes a first end and a second end and the cushion body has a generally arcuate shape between the first and second ends. The cushion body defines a vertical axis about which the cushion body curves. The cushion body tapers inward in a direction parallel to the vertical axis to define the depression. In such instances, the depression typically extends along a majority of the length of the cushion body between the first and second ends. The depression may be positioned on an upper surface of the cushion body, a lower surface of the cushion body, or on both surfaces of the cushion body. The depression may be formed or defined by tapering means that are coupled with the cushion body, such as darting that is sewn into the cushion body, a baffle, or material that is coupled with the cushion body, and the like. The depression may form or define a dimpled, doubly curved, or double torus shaped medial region that provides a low angle region in which the infant/child may be positioned, such as during feeding.

In another instance, the cushion body includes a medial region and two opposing arms that define an outer perimeter and a generally open well. The two opposing arms curve away from the medial region so that the cushion body has a roughly toroidal configuration defining a vertical central axis. The medial region includes or defines two opposing surfaces—i.e., an upper surface and a lower surface. The medial region tapers inward between the two opposing arms in a direction parallel to the vertical central axis so that the cushion body is narrowed in the medial region between the two opposing arms. Stated differently, the two opposing surfaces include a dipped region where the two opposing surfaces dip toward each other. The contoured support cushion also typically includes a cover that is positioned over the cushion body and cushioning or fill material (hereinafter fill material) that is positioned within the cushion body.

In some embodiments, one of the opposing arms, or both of the opposing arms, may include or define opposing surfaces that taper inward in a manner similar to the medial region. Specifically, the opposing surfaces of the opposing arm, or opposing arms, may taper inward in a direction parallel to the vertical central axis so that the cushion body is narrowed in the opposing arm or opposing arms. Similar to the medial region, the surfaces of the opposing arm, or opposing arms, may include a dipped region where the two surfaces dip toward each other. In such embodiments, the cushion body may have two or three inward tapering regions.

The narrowed medial region of the cushion body typically results in the medial region having a dimpled, doubly curved, or double torus shape. In some instances, the infant/child's rear can be positioned in the dimpled, doubly curved, or double torus shaped medial region when a parent or guardian is feeding the child. The dimpled, doubly curved, or double torus shaped medial region provides a low angle region in which the infant/child may be positioned. Proper positioning of an infant/child on the low angle cushion body may reduce acid reflux and/or allow the infant/child to be supported in a more comfortable orientation.

Figure 3:
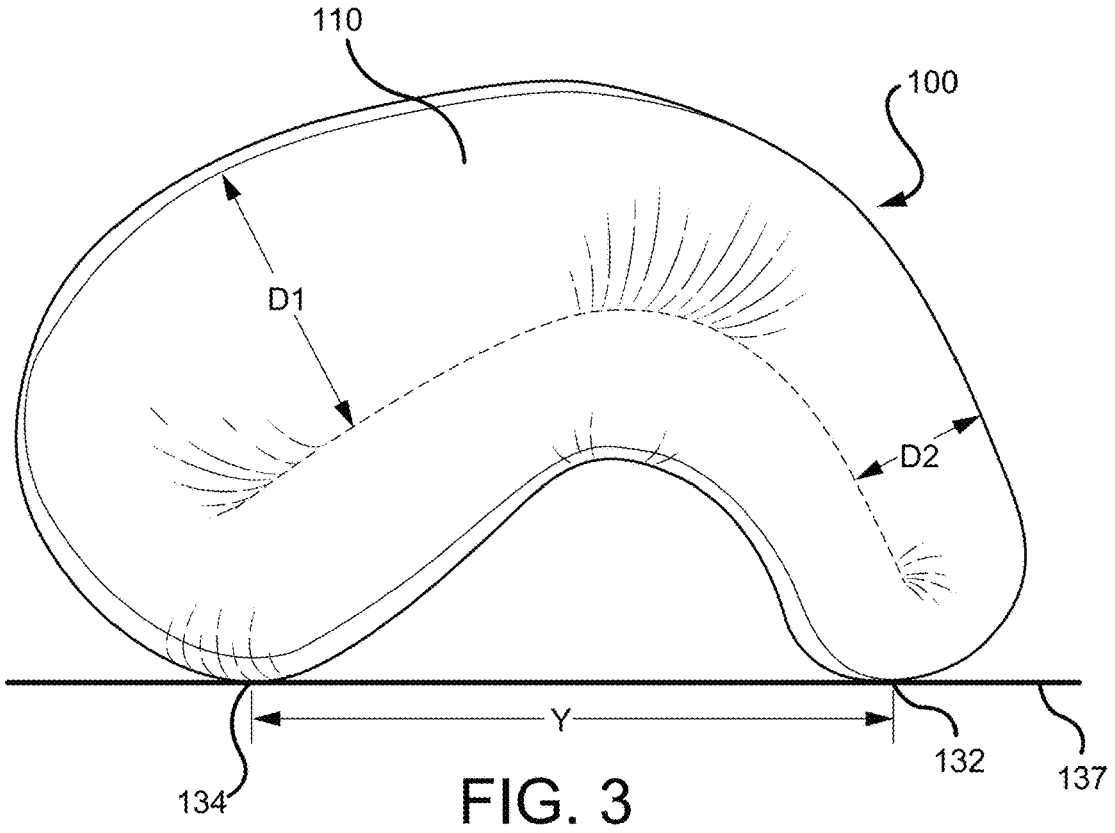
Figure 4:
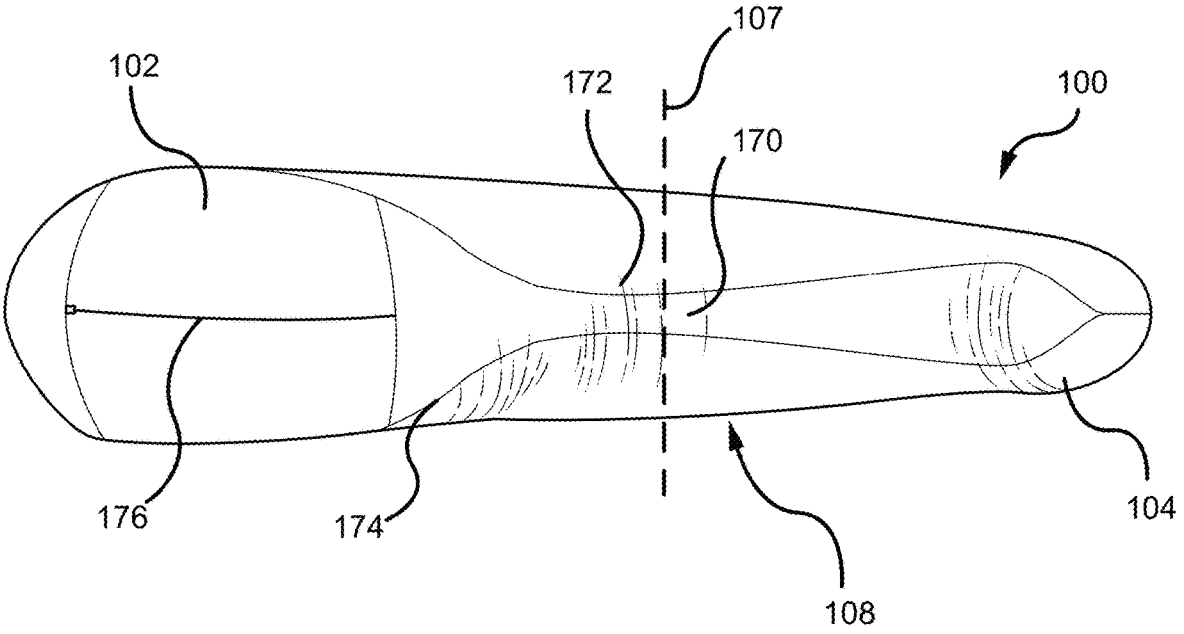
FIGS. 4-5 are side views of the contoured surface support cushion of FIG. 1.
Figure 5:
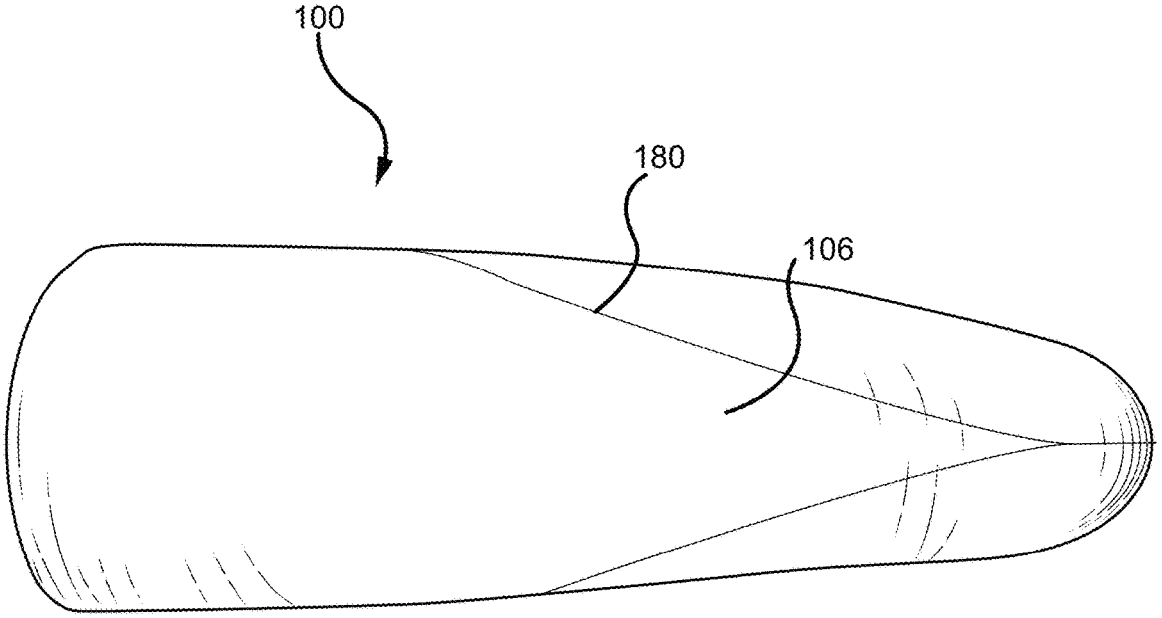

Referring to FIGS. 1-5, a support cushion is illustrated. The support cushion is designed to comfortably serve consumers of all body types and infants or babies ages 0 months and up. Comfort is achieved, in part, by the formation of an open well and a curved design that conforms to a caregiver's body while fully supporting the weight and length of the baby. The support cushion includes a cushion body 100 that includes fill material (not shown) and an outer material layer or covering that encompasses the fill material. The cushion body 100 has a first end 102 and a second end 104 and the cushion body 100 has a generally arcuate or curved shape between the first end 102 and the second end 104. The arcuate or curved shape defines or forms an open well or inner section. In some instances, the cushion body 100 has a continuous curve between the first and second ends, 102 and 104, although in other instances the cushion body 100 has one or more roughly curved and straight portions. The cushion body 100 defines a vertical axis 107 (see FIG. 4) about which the cushion body 100 curves. The cushion body 100 also has an outer peripheral edge 106 and an inner peripheral edge 108. As illustrated in FIG. 1, the outer peripheral edge 106 and inner peripheral edge 108 may both curve about the vertical axis 107 defined by the cushion body 100, although in other instances only one of the outer peripheral edge 106 or inner peripheral edge 108 may curve about the vertical axis 107. A curvature of the outer peripheral edge 106 may correlate or correspond with a curvature of the inner peripheral edge 108. As shown in FIGS. 4-5, the cushion body 100 has a generally flat top and bottom surface between the outer peripheral edge 106 and the inner peripheral edge 108. As shown in FIG. 4, the cushion body 100 tapers slightly between the first end 102 and the second end 104 so that the cushion body 100 has a slight wedge shape. The first end 102 is typically thicker than the second end 104.

The cushion body 100 may also taper inward in a direction parallel to the vertical axis 107 to define a depression 120 in the cushion body 100. The depression 120 is formed or defined in a mid-section of the cushion body and extends longitudinally along the cushion body 100. The depression 120 aids in shaping the cushion body 100 to have the flat top and bottom surfaces. The depression 120 typically has an arcuate or curved shape that corresponds to the arcuate or curved shape of the cushion body 100. The depression 120 is typically positioned roughly centrally between the outer peripheral edge 106 and the inner peripheral edge 108, although the depression 120 may be positioned closer to the outer peripheral edge 106 or inner peripheral edge 108 as desired. The depression 120 may be formed on an upper or lower surface of the cushion body 100, but is typically formed on both the upper and lower surfaces of the cushion body 100. The depression 120 segments or divides the cushion body 100 into an outer cushion portion or section 110 and an inner cushion portion or section 112. The outer cushion portion 110 and the inner cushion portion 112 typically have a roughly equivalent thickness as measured in the direction parallel to the vertical axis (see FIG. 8). In other instances, however, a thickness of the inner cushion portion 112 may be less than a thickness of the outer cushion portion 110, or vice versa. A roughly equivalent thickness of the inner cushion portion 112 and outer cushion portion 110 results in the cushion body 100 having a relatively flat or level upper and/or lower surface (see FIG. 8), which may aid in supporting a child. The outer cushion portion 110 and the inner cushion portion 112 also typically have a flat top and bottom surface. In instances where the inner cushion portion 112 is thinner than the outer cushion portion 110, the cushion body 100 may taper slightly inward from the outer cushion portion 110 to the inner cushion portion 112.

The amount of fill material used in the inner cushion portion 112 and the outer cushion portion 110 may be selected such that a firmness of the inner cushion portion 112 is roughly equivalent to the outer cushion portion 110, although in other instances the amount of fill material may be selected so that the inner cushion portions 112 is softer than the outer cushion portion 110, or vice versa. In a specific embodiment, the cushion body 100 includes sufficient fill material to provide substantially all of the cushion body 100 with a prescribed firmness where a force of at least 10 Newtons applied over at least 30 seconds is required to displace a 3-inch diameter hemispheric probe 1 inch into the cushion body 100. For some uses, the firmness of the cushion body 100 will be greater than the above described firmness (e.g., capable of withstanding greater force and/or for longer time), while for other uses, the firmness may be less than the above prescribed firmness.

In instances where the depression 120 is typically positioned roughly centrally between the outer peripheral edge 106 and the inner peripheral edge 108, a width of the outer cushion portion 110, as measured from the outer peripheral edge 106 to the depression 120, may be roughly equal to a width of the inner cushion portion 112, as measured from the inner peripheral edge 108 to the depression 120. In other instances, the depression 120 is positioned closer to the inner peripheral edge 108 so that the width of the outer cushion portion 110 is greater than the width of the inner cushion portion 112.

As previously noted, the depression 120 typically has an arcuate or curved shape corresponding to the arcuate or curved shape of the cushion body 100. More specifically, the curve of the depression 120 may be the same as the curve of the inner peripheral edge 108 and/or outer peripheral edge 106. The depression 120 may extend along a majority a length of the cushion body 100 between the first end 102 and the second end 104. The depression 120 may be measured between distal ends, 121 and 122, of the depression. In some embodiments, a length of the depression 120 between the distal ends, 121 and 122, may extend between 60 and 90 percent, between 65 and 85 percent, or between 70 and 80 percent, of the length of the cushion body 100 between the first end 102 and the second end 104. In some embodiments, the length of the depression 120 between the distal ends, 121 and 122, may be between 10 and 27 inches.

A cross sectional profile of the cushion body 100 differs slightly at the distal ends, 121 and 122, of the depression 120 in comparison with a central portion of the cushion body 100. For example, a cross section profile of the cushion body 100 (i.e., a section of the cushion body 100 in a vertical plane) taken radially at the distal ends, 121 and 122, is generally oval or elliptical in shape whereas a cross section profile of the cushion body 100 with a central portion of the cushion body 100 is generally hourglass in shape (see FIG. 8). The hourglass shape in the central portion is the result of the depression 120 in the cushion body 100 pulling the outer material layer or covering inward. The cross section profile of the cushion body 100 gradually transitions from being generally oval or elliptical to being generally hourglass as the cross section moves away from the ends of the cushion body and toward the lateral center of the cushion body. Stated differently, the depression 120 or inward taper of the upper surface and lower surface of the cushion body 100 provides a gradual transition between a central portion of the cushion body 100 and the first and second ends, 102 and 104.

In some instances, the cushion body 100 is shaped so that it is not symmetrical about a plane that intersects the lateral center of the cushion body 100. For example, the second end 104 may have a width $W_2$ in a direction orthogonal to the vertical axis 107 that is smaller than a width $W_1$ of the first end 102 (see FIGS. 2-3). In such instances, the cushion body 100 may have a shape that is similar to a cashew with a narrower end (e.g., the second end 104) and a wider end (e.g., the first end 102). This shape may be conducive to supporting or cushioning a child. For example, the narrower end may be used for a smaller child and the wider end may be used for a larger child.

In some instances, the width $W_1$ of the first end 102 may be between 8 and 15 inches and the width $W_2$ of the second end 104 may similarly be between 8 and 15 inches. When the cushion body 100 has a cashew shape, the width $W_2$ of the second end 104 may be between 70 and 95 percent of the width $W_1$ of the first end 102, and more commonly between 75 and 90 percent of the width $W_1$ of the first end 102. In some instances, a distance of the depression 120 from the inner peripheral edge may be constant even though the cushion body 100 has a non-symmetrical cashew shape. In such instances, a distance $D_1$ of the depression 120 from the outer peripheral edge 106 may be greater in the first end 102 than a distance $D_2$ of the depression 120 from the outer peripheral edge 106 in the second end 104. This configuration of the cushion body 100 and depression 120 may result in a gradually widening of the outer cushion portion 110 between the second end 104 and the first end 102. In such instances, a width of the inner cushion portion 112 may remain relatively constant or uniform between the second end 104 and the first end 102. The distance of the depression 120 from the inner peripheral edge 108 may be between 3 and 7 inches.

The size and angle of the cushion body 100 is ideal for various feeding scenarios and accommodates seats of various size. The shape and size of the cushion body 100 improves a caregiver's ability to properly position an infant or baby while feeding the infant or baby in a safe and efficient manner. In some instances, a linear or straight line distance Y between opposite ends, 132 and 134, of the arcuate or cashew shaped cushion body 100 is between 15 and 19 inches. The opposite ends, 132 and 134, of the arcuate or cashew shaped cushion body 100 are defined as the two points or portions of the cushion body 100 that would contact a flat plane 137 and support the cushion body 100 in a vertically oriented position as illustrated in FIG. 3. This configuration of the cushion body 100 allows the support cushion to fit between the arms of most chairs, which commonly have a width of around 20 inches. A larger sized cushion body 100 would not fit comfortably in most chairs and would thus reduce the number of achievable feeding positions. In addition, a smaller sized cushion body 100 may not offer adequate support to balance out a baby's body weight, which could cause fatigue for a caregiver. In addition, a radius of curvature of the inner peripheral edge 108 may be between 10 and 20 inches.

Figure 6A:
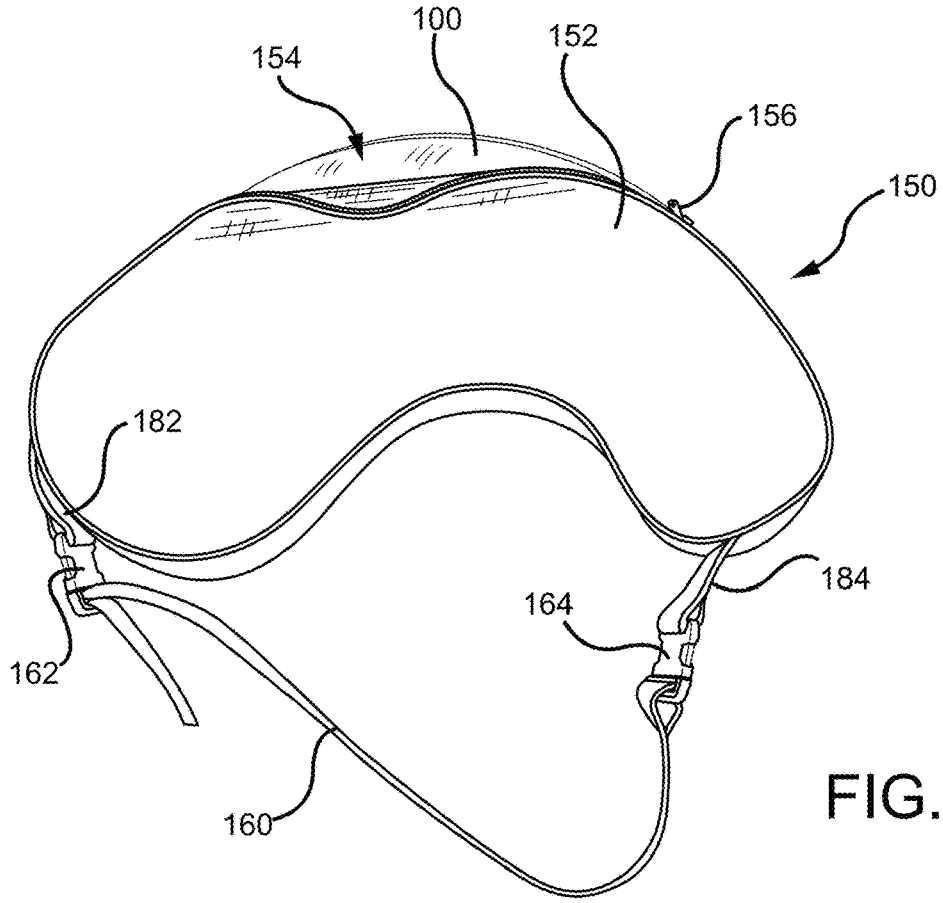
FIGS. 6A-D are perspective views of a decorative cover of the contoured surface support cushion of FIG. 1.
Figure 6B:
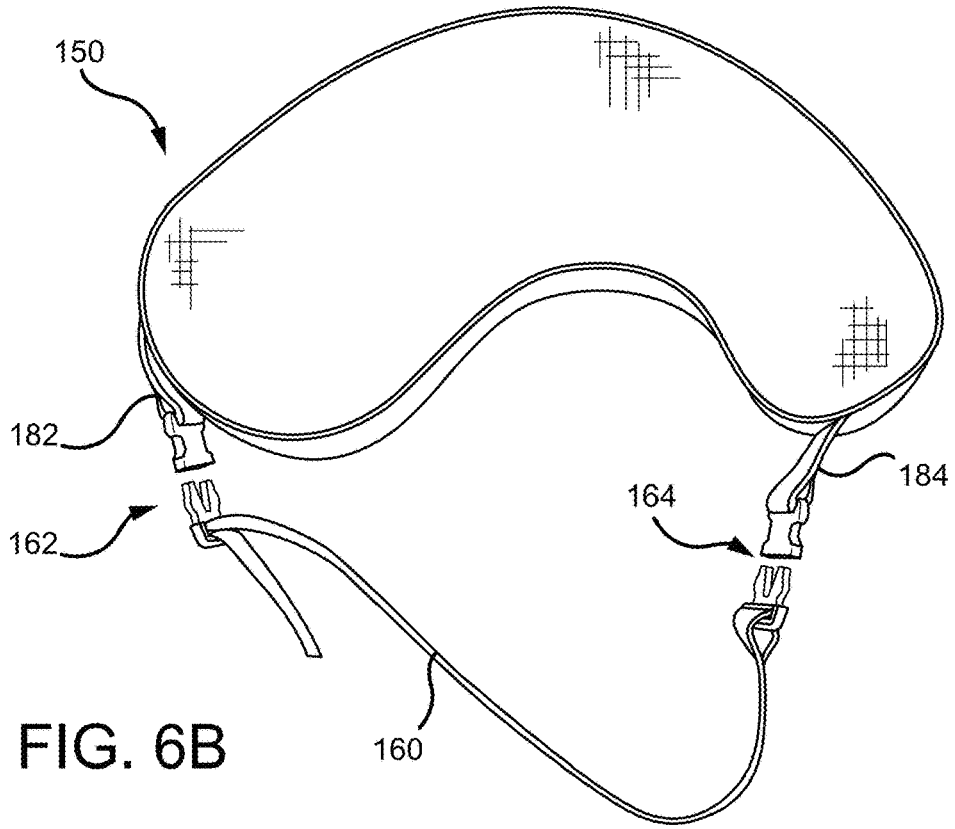

FIGS. 4-5 illustrate various side views of the cushion body 100. While the cushion body 100 is illustrated as having a slight taper, the cushion body 100 is generally flat. The flat surface of the cushion body 100 is achieved via the tapering means sewn into, or otherwise coupled with, the cushion body 100. The tapering means form or define the depression 120 in the cushion body 100, which enables the support cushion to have a generally flat surface when a decorative cover 150 (see FIG. 6A) is positioned over the cushion body 100. In other instances, the cushion body 100 may taper. In such instances, a center section of the cushion body 100 may be thicker than the first and second ends, 102 and 104. In some embodiments, the cushion body 100 may be between 4 and 9 inches thick.

As illustrated in FIG. 4, the inner peripheral edge 108 of the cushion body 100 includes a gusset 170 that is coupled along a vertical midsection of the inner peripheral edge 108 and that extends about or around the open well or inner section of the cushion body 100. The gusset 170 is adapted to prevent tearing of the cushion body 100 adjacent to the inner peripheral edge 108 of the well during use, such as upon movement or deflection of the first and second ends, 102 and 104. The gusset 170 may be a strip or section of material that is sewn to a top piece and a bottom piece of the outer material layer or cover of the cushion body 100. The gusset 170 may extend between the opposite ends, 132 and 134, along a mid-plane of the cushion body 100. The gusset 170 eliminates a seam that would otherwise run along the mid-plane of the cushion body 100 around the open well. In some instances, the gusset 170 may have a uniform thickness along its entire length or the thickness may vary, such as by having thicker ends 174 in comparison with a central section 172 of the gusset 170.

The first end 102 of the cushion body 100 includes a zipper 176 that closes an opening of the cushion body 100. Although a zipper 176 is illustrated, in some embodiments another mechanical fastener, such buttons, stitching, and/or hook and loop fasteners could be used. The opening that is closed by the zipper 176 may be between 4 inches and 9 inches long, and more commonly between about 5 inches and 8 inches. The zipper 176 is typically located on the interior of the cushion body 100 so as to be inaccessible to a user and commonly hidden from view. The opening may be stitched in a manner so that it has the visual appearance of a seam, thereby helping to conceal or hide the zipper 176 from view. The opening may have any number of back-stitches over a seam to secure the zipper 176 to the opening while the cushion body 100 is filled to the prescribed firmness where a force of at least 10 Newtons is required to displace a 3-inch diameter hemispheric probe one inch into the pillow body 201. In some instances, a fabric brace may be used in addition to or as an alternative to the back stitches. The fabric brace may be placed on the inside of the cushion body 100 at one or both ends of the zipper opening.

FIG. 5 similarly illustrates that the outer peripheral edge 106 of the cushion body 100 may include a gusset 180 that is coupled along a vertical midsection of the outer peripheral edge 106 and that extends partially or fully around an outer periphery of the cushion body 100. The gusset 180 is similarly adapted to prevent tearing of the cushion body 100 during use, such as upon movement or deflection of the first and second ends, 102 and 104, or rotation of the cushion body 100. The gusset 180 may be a strip or section of material that is sewn to a top piece and a bottom piece of the cushion body 100. The gusset 180 may extend partially or fully between the opposite ends, 132 and 134, along a mid-plane of the cushion body 100. The gusset 180 may eliminate a seam that would otherwise run along the mid-plane of the cushion body 100. The gusset 180 typically has a varying thickness along its length, such as having thicker midsection in comparison with its opposing ends.

FIGS. 6A-D illustrate a decorative cover 150 that may be positioned over the cushion body 100. The decorative cover 150 includes an upper surface 152 and a lower surface 153 (see FIG. 7A) that corresponds to the upper surface. The cover 150 further includes a side wall that extends around a periphery of the cover 150 and connects the upper surface 152 to the lower surface. The cover 150 also includes an opening 154 on an outer edge of the cover 150. The cushion body 100 is insertable within the opening 154 and removable therefrom to enable the cover 150 to be positioned over the cushion body 100. The cover also includes a mechanical fastener 156 that allow the opening 154 to be closed over the cushion body 100 to encase the cushion body 100 in the cover 150. The mechanical fastener 156 could be a zipper, buttons, snaps, magnets, clips, and the like.

When positioned over the cushion body 100, the upper surface 152 and the lower surface 153 of the cover 150 are relatively flat, which provides a supporting and cushioning surface that a baby or infant may be positioned on and/or that may support an object or body part of the user, such as during knitting, gaming, or various other activities. The cover 150 may be constructed of various decorative and/or comfortable materials that are known in the art.

In some embodiments, the cover 150 includes a belt or strap 160 (hereinafter belt 160) that is detachably coupled with the cover 150. The belt 160 includes a main strap body and buckles, 162 and 164, or fastening means on opposing sides of the belt 160. The cover 150 includes a first strap or flange 182 (hereinafter first strap 182) that includes a buckle that connects with a first buckle 162 of the belt 160. The cover 150 similarly includes a second strap or flange 184 (hereinafter second strap 184) that includes a buckle that connects with a second buckle 164 of the belt 160. The buckles, 162 and 164, are detachable from the corresponding straps, 182 and 184, to detach the belt 160 from the cover 150. In some instances, the buckles, 162 and 164, may be differently sized. For example, in embodiments where the cushion body 100 and cover 150 taper between the first end 102 and the second end 104, such as the embodiment illustrated in FIG. 4, the buckle corresponding to the second end (i.e., buckle 164) may be sized smaller than the buckle corresponding to the first end (i.e., buckle 162). Differently sized buckles, 162 and 164, may result in the belt 160 being attachable to the cover 150 in a single orientation or configuration.

The belt 160 may include a belt stop snapper (not shown) that can limit the length that the belt 160 can be tightened and thereby prevent opposing ends of the cushion body 100 from touching. In certain embodiments, the belt stop snapper may be included between about 9 inches to about 17 inches from an end of the belt 160, such as the end associated with buckle 162. In other instances, the belt stop snapper may be included between about 11 inches to about 15 inches from the end of the belt 160 or between about 12.5 inches to about 13.5 inches from the end of the belt 160.

Figure 6C:
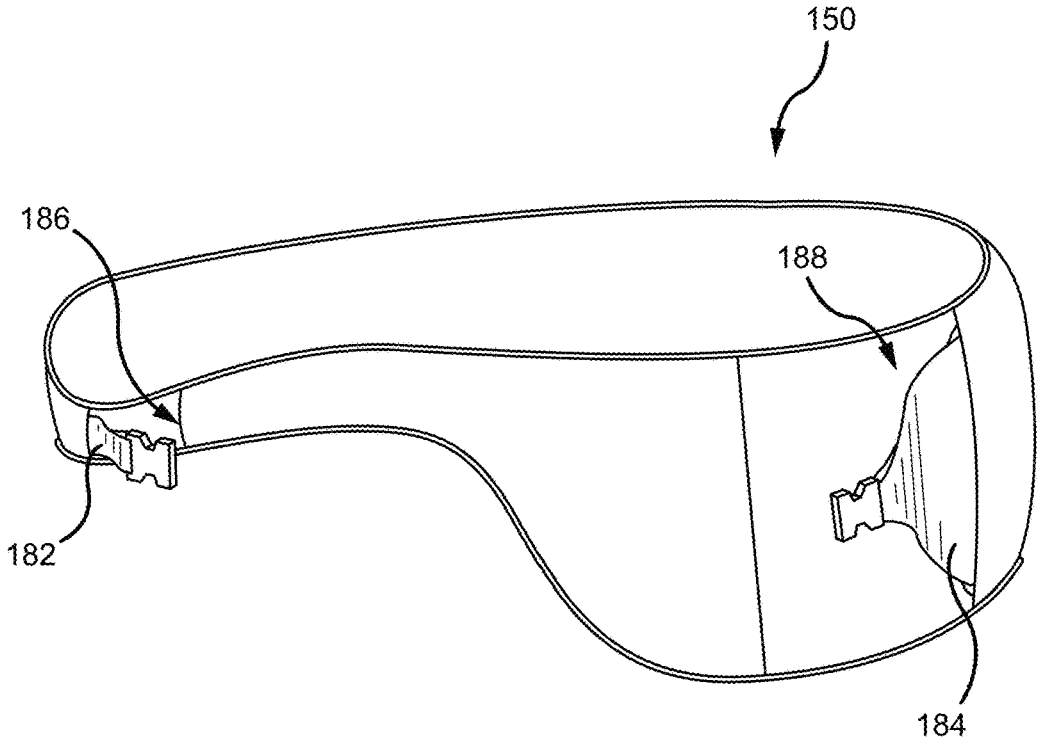
Figure 6D:
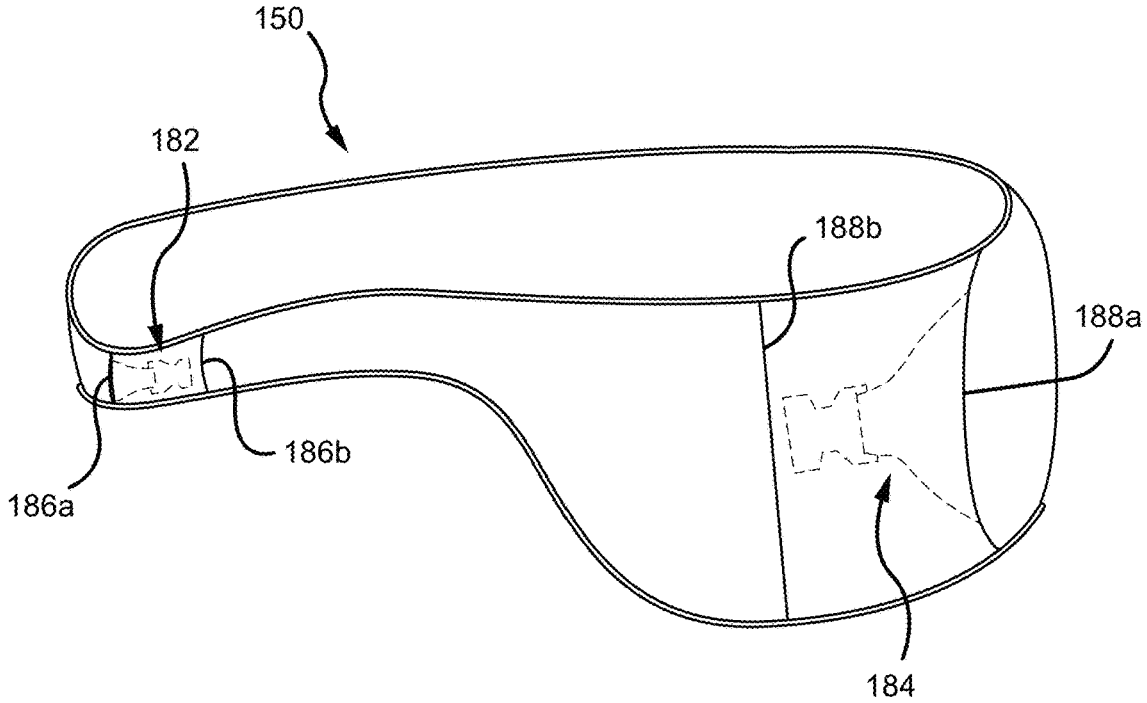

FIGS. 6C-D illustrate a means for stowing the straps, 182 and 184, in the cover 150 when the straps, 182 and 184, are detached from the belt 160. Specifically, the cover 150 includes pockets or seams, 186 and 188, within which the straps, 182 and 184, may be positioned when detached from the belt 160. FIG. 6C illustrates the straps, 182 and 184, in a detached state in which the straps, 182 and 184, are free floating or positioned atop an inner surface of the cover 150. In FIG. 6D, the straps, 182 and 184, are positioned in the respective pockets, 186 and 188. Specifically, a first pocket 186 is defined in the cover 150 between a first vertical seam 186*a* and a second vertical seam 186*b*. An opening is formed in the first vertical seam 186*a* so that the pocket 186 may be opened and the strap 182 inserted within the pocket 186. The vertical seams, 186*a* and 186*b*, are spaced so that the entire strap 182 may be positioned within the pocket 186 without folding or wrinkling the cover 150. Similarly, a second pocket 188 is defined in the cover 150 between a first vertical seam 188*a* and a second vertical seam 188*b*. An opening is formed in the first vertical seam 188*a* so that the pocket 188 may be opened and the strap 184 inserted within the pocket 188. The vertical seams, 188*a* and 188*b*, are spaced so that the entire strap 184 may be positioned within the pocket 188 without folding or wrinkling the cover 150. When positioned within the pockets, 186 and 188, the straps, 182 and 184, are concealed from view. In such instances, the cover 150 may appear to not include any straps, 182 and 184.

Figure 7A:
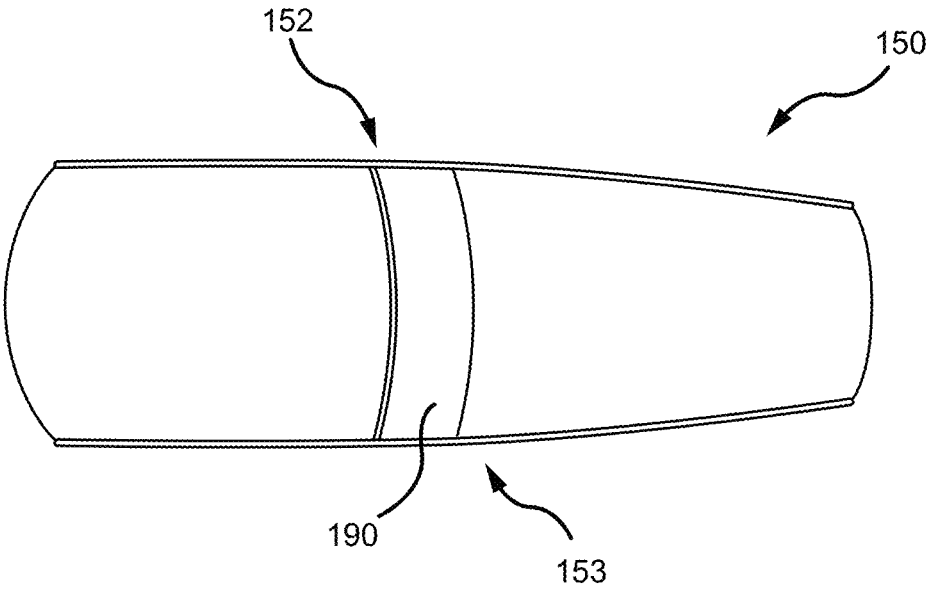
FIG. 7A is a rear side view of the decorative cover of FIGS. 6A-D.

FIG. 7A illustrates a side rear view of the cover 150 fitted about the cushion body 100. As previously described, the top surface 152 and the lower surface 153 of the cover 150 are substantially flat when the cover 150 is fit about the cushion body 100. In addition, the cover 150 may include a handle 190 that may be used for carrying the cover 150 and cushion body 100 and/or for repositioning the cover 150 and cushion body 100 about the user's body. For example, the handle 190 may be grasped and the cushion body 100 may be rotated around a torso of the user to adjust a support of an infant or child or to support another object or body part during use. The handle 190 is positioned so that the user may adjust the cover 150 and cushion body 100 with a single hand. The handle 190 is formed of a strip of material that is attached to the top surface 152 and the bottom surface 153 of the cover. The strip of material is typically sewn to the cover in a manner so that the handle 190 fits firmly against the exterior surface of the cover 150. The strip of material may be between 1 and 4 inches wide, and more commonly is between 2 and 3 inches wide.

Figure 7B:
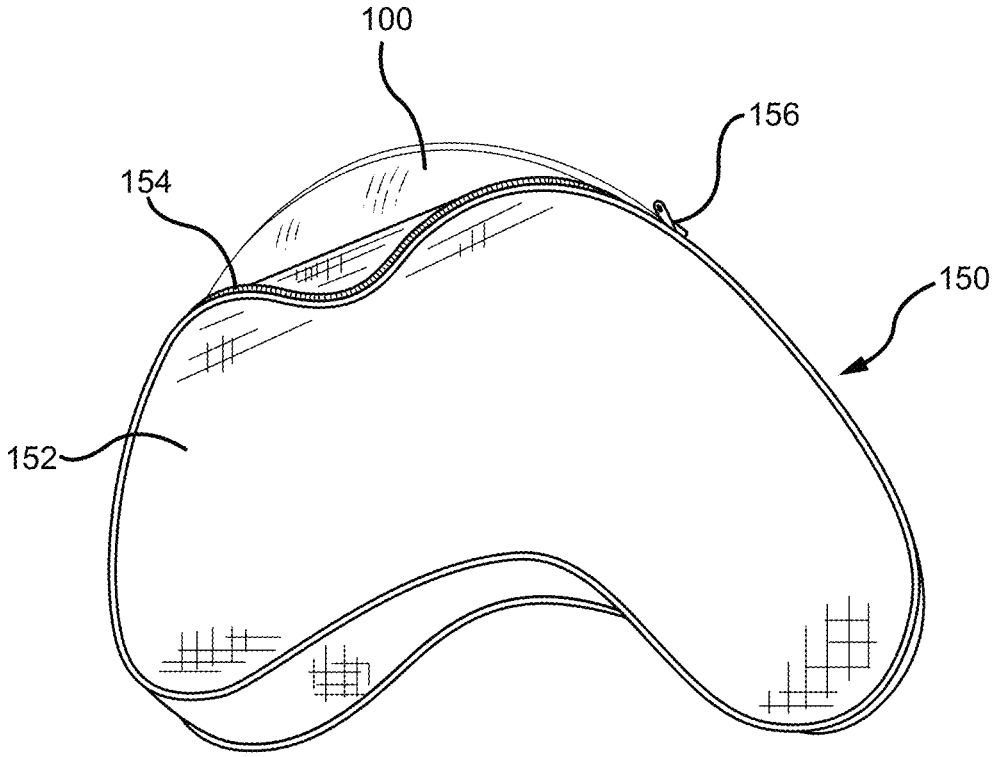
FIG. 7B is a perspective view of another embodiment of a decorative cover of the contoured surface support cushion of FIG. 1.

FIG. 7B illustrates another embodiment of a cover 150. The cover is substantially similar to the cover illustrated in FIG. 6A, except that the cover 150 does not include buckles, 162 and 164. As such, the cover 150 of FIG. 7B is not attachable to a belt 160.

Figure 8:
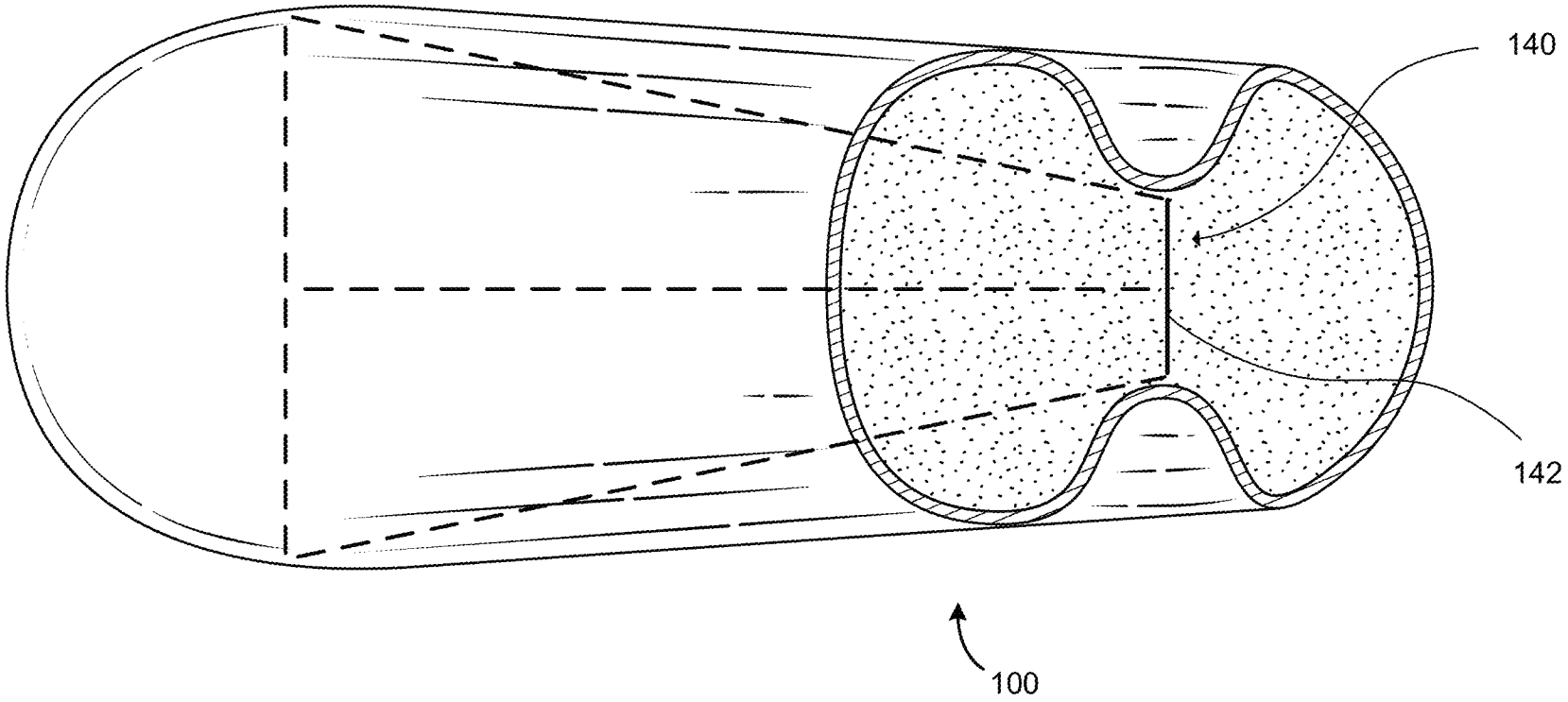
FIG. 8 is a cross section view of the contoured surface support cushion of FIG. 1 illustrating a connector or tapering means that forms or defines a tapered contour.

FIG. 8 illustrates a connector or baffle 140 that is coupled with an upper surface and lower surface of the cushion body 100 and functions as a tapering means that forms or defines the depression 120. The baffle 140 is sewn into a middle of the cushion body 100 and functions to keep a top of the outer cushion portion 110 and the inner cushion portion 112 relatively flat, which similarly enables the upper surface 152 of the cover 150 to be flat when positioned over the cushion body 100. The baffle 140 similarly enables the lower surface of the cover to be flat when positioned over the cushion body 100, which may aid in properly positioning the support cushion on a chair or other supportive object. FIGS. 15-17 illustrate various other tapering means that could be coupled with, or formed on, an inner surface and/or lower surface of the cushion body 100 to form or define the depression 120, such as one or more darting segments that are sewn into the inner surface of the cushion body 100 along the length of the depression 120.

In the illustrated embodiment of FIG. 8, the baffle 140 is coupled with an upper and lower surface of the cushion body 100 and forms an inner wall 142 that segments or divides the outer cushion portion 110 from the inner cushion portion 112. The baffle 140 extends along an entire length of the depression 120 and along a majority of the length of the cushion body 100. The baffle 140 includes a tapered mid-section that extends between a large end and a narrow end. The tapered midsection typically has a length that closely corresponds with the length of the depression 120. In some embodiments, the tapered midsection has a thickness of between 1 and 6 inches, and more commonly between 2 and 5 inches, or between 2 and 4 inches. The large end is typically equal to the thickness of the first end 102 of the cushion body 100 or slightly smaller than the first end 102. Similarly, the short end is typically equal to the thickness of the second end 104 of the cushion body 100 or slightly smaller than the second end 104. The use of the baffle 140 results in the cushion body 100 having an hourglass or figure eight cross section profile. An exemplary baffle 140 that may be used in the cushion body 100 is illustrated in FIG. 15B.

Referring to FIGS. 9-14, a support cushion 200 is illustrated. The support cushion 200 includes a cushion body 202 that includes fill material (not shown) and a cover disposed about the fill material. The cushion body 202 has a medial region 210 and two opposing arms, 220 and 222, that define an outer perimeter 204 and a generally open well 206. The two opposing arms, 220 and 222, curve away from the medial region 210 so that the cushion body 202 has a roughly toroidal configuration that defines a vertical central axis 207 (see FIG. 10).

The support cushion 200 may be constructed to have an overall shape, size, and/or feel similar to the products described in U.S. Pat. Nos. 5,661,861, 5,546,620, 5,261,134 and 6,055,687, each of which are incorporated by reference herein. Specifically, support cushion 200 includes a curved outer surface which is rounded in both a longitudinal and a lateral direction to form the outer perimeter 204. Support cushion 200 further includes a curved central inner surface, which defines the open well 206. The open well 206 has a rounded, generally circular or elliptical shape. The two opposing arms, 220 and 222, include respective blunt ends that are positioned remotely of the medial region 210. Support cushion 200 is shaped so that it has bilateral symmetry about a plane that intersects the medial region 210 and includes the vertical central axis 207.

Profiles of the support cushion 200 taken radially of the vertical central axis 207—i.e., sections of the cushion 200 in planes that also contain the vertical central axis 207—are generally circular or elliptical in shape in each of the opposing arms, 220 and 222. The medial region 210 tapers inward between the two opposing arms, 220 and 222, in a direction that is parallel to the vertical central axis 207, which results in the cushion body 202 narrowing in the medial region 210 between the two opposing arms, 220 and 222. As such, profiles of the medial region 210 taken radially of the vertical central axis 207 transition from being generally circular or elliptical in shape to being generally dimpled, doubly curved, or double torus in shape, which is described in greater detail hereinbelow (see FIG. 14). The open well 206 has a width in a direction perpendicular to the vertical central axis 207 that may be designed to fit around the torso or waist of a user. The support cushion 200 may be constructed so that the arms, 220 and 222, may be moved away from each other to vary the width of the open well 206, which may allow the cushion 200 to be used in a variety of applications.

Figure 18:
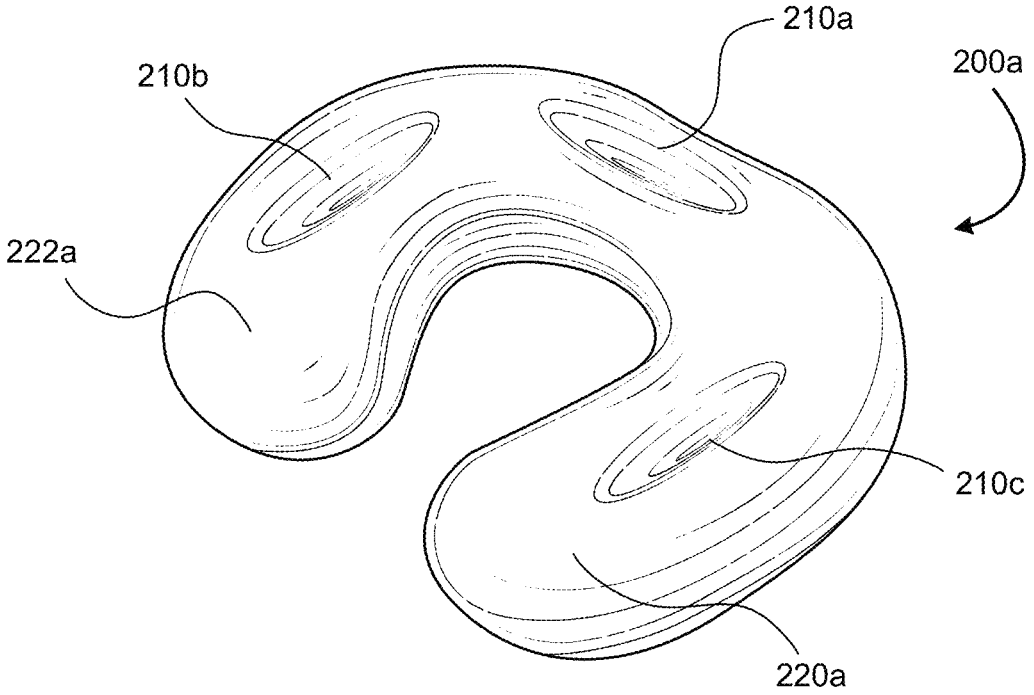
FIG. 18 illustrates a perspective view of an alternative embodiment of a contoured surface support cushion.

While medial region 210 is illustrated as being centrally positioned relative to the cushion body 202 (e.g., positioned centrally between the blunt ends of the opposing arms 220 and 222), in some embodiments the medial region 210 may be offset from such a central positioning. In such embodiments, the medial region 210 may be closer to the blunt end of one opposing arm than the other. An example of an offset medial region 210 is illustrated in FIG. 18.

Figure 10:
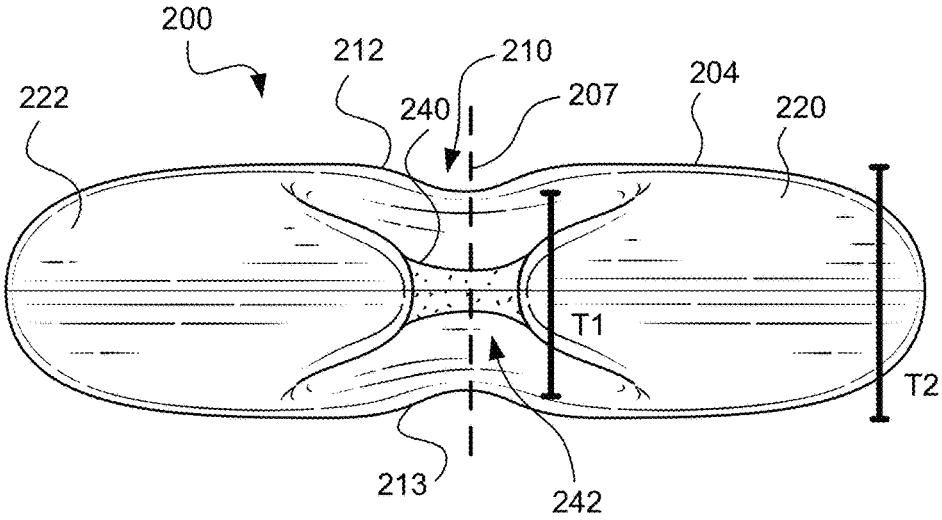
FIG. 10 is a front view of the contoured surface support cushion of FIG. 9.
Figure 11:
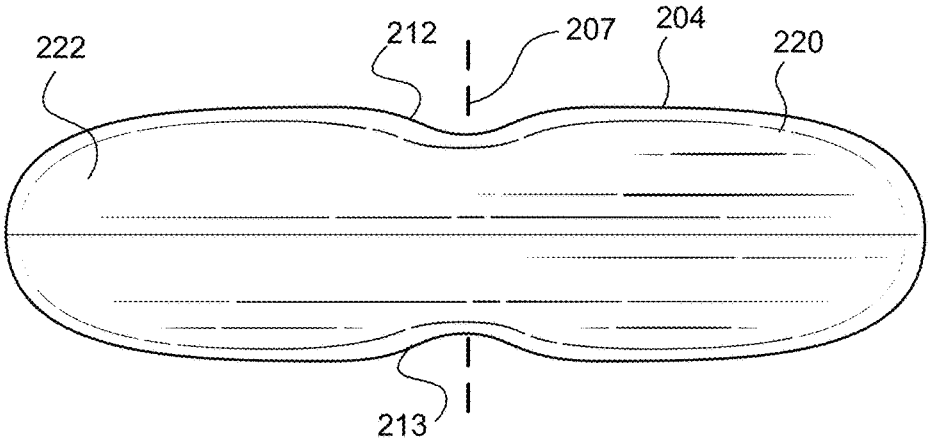
FIG. 11 is a back view of the contoured surface support cushion of FIG. 9.

FIG. 10 illustrates a tapering section of the medial region 210 of the cushion body 202. As illustrated in FIG. 10, both an upper surface 212 and a lower surface 213 of the medial region 210 may taper vertically inward between the two opposing arm, 220 and 222. In such embodiments, the medial region 210 has a figure eight or hourglass configuration between the opposing arms, 220 and 222, when viewed from the front as in FIG. 10. The inward taper of the upper surface 212 and lower surface 213 provides a gradual transition from the opposing arms, 220 and 222, to a narrowest point of the medial region 210. In other embodiments, only the upper surface 212 or the lower surface 213 may taper vertically inwardly between the opposing arms, 220 and 222. In such embodiments, the medial region would have a more U-shaped or dipped profile when viewed from the front. The non-tapering surface would be relatively planar or generally flat with the corresponding surfaces of the opposing arms, 220 and 222. In such instances, the upper surface 212 is more commonly tapered and the lower surface 213 is more commonly level or flat with the lower surfaces of the opposing arms, 220 and 222.

In some embodiments, a minimum thickness $T_1$ of the medial region 210 may be between 1.5 and 4 inches, and more commonly between 1.5 and 3 inches or 2 and 2.5 inches. In contrast, a maximum thickness $T_2$ of the cushion body 202, which typically occurs in the opposing arms, 220 and 222, may be between 5 and 10 inches, and more commonly between 5 and 8 inches or between 6 and 8 inches. The medial region 210 of the cushion body 202 transitions from the minimum thickness $T_1$ to the maximum thickness $T_2$ so that opposing ends of the medial region 210 have a thickness that corresponds with, or matches, the maximum thickness $T_2$ of the cushion body 202. Stated differently, opposing ends of the medial region 210 may have a thickness roughly equal to the maximum thickness $T_2$ of the cushion body 202 while a central section of the medial region 210 has a thickness equal to the minimum thickness $T_1$. The medial region 210 typically transitions gradually between the maximum thickness $T_2$ and minimum thickness $T_1$. The controlled graduation from the center to the edges or ends of the medial region 210 may be achieved by a connector or tapering means that are coupled with the cushion body 202 as described herein. In other embodiments, the graduation or transition between the center and ends of the medial region 210 may be uncontrolled (not shown) so that a more abrupt transition between the maximum thickness $T_2$ and minimum thickness $T_1$ occurs or is achieved. The uncontrolled graduation may be achieved based on the connector/tapering means employed in the cushion body 202.

Figure 12:
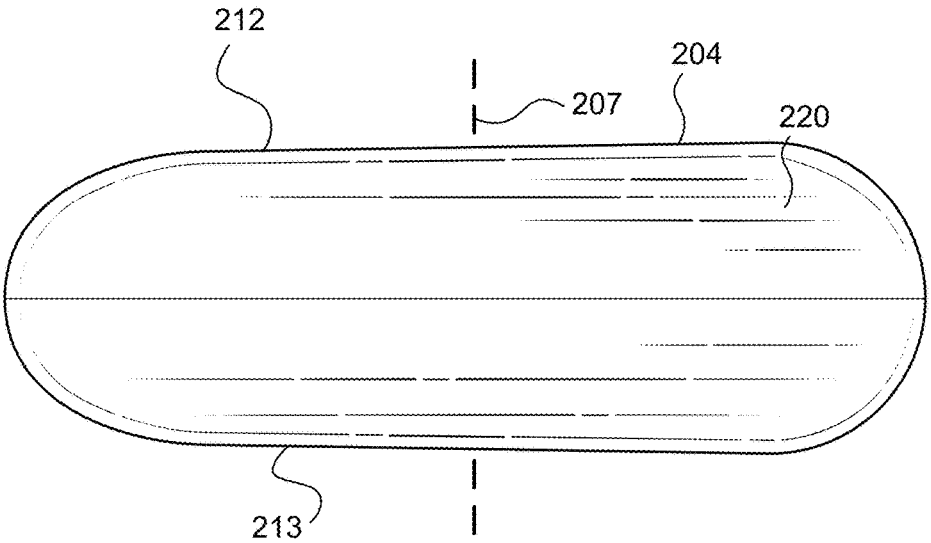
FIG. 12 is a side view of the contoured surface support cushion of FIG. 9.

As illustrated in FIG. 12, the upper and lower surfaces, 212 and 213, of the opposing arms, 220 and 222, are more linear or slightly tapered in comparison with the medial region 210. The upper surface 212 of the opposing arms, 220 and 222, may be relatively flat, which may be beneficial for comfort and/or supportive purposes. To increase the flatness of the upper surface 212 of the opposing arms, 220 and 222, the fill material in the arms may be reduced, which may reduce the loft of the arms.

Figure 9:
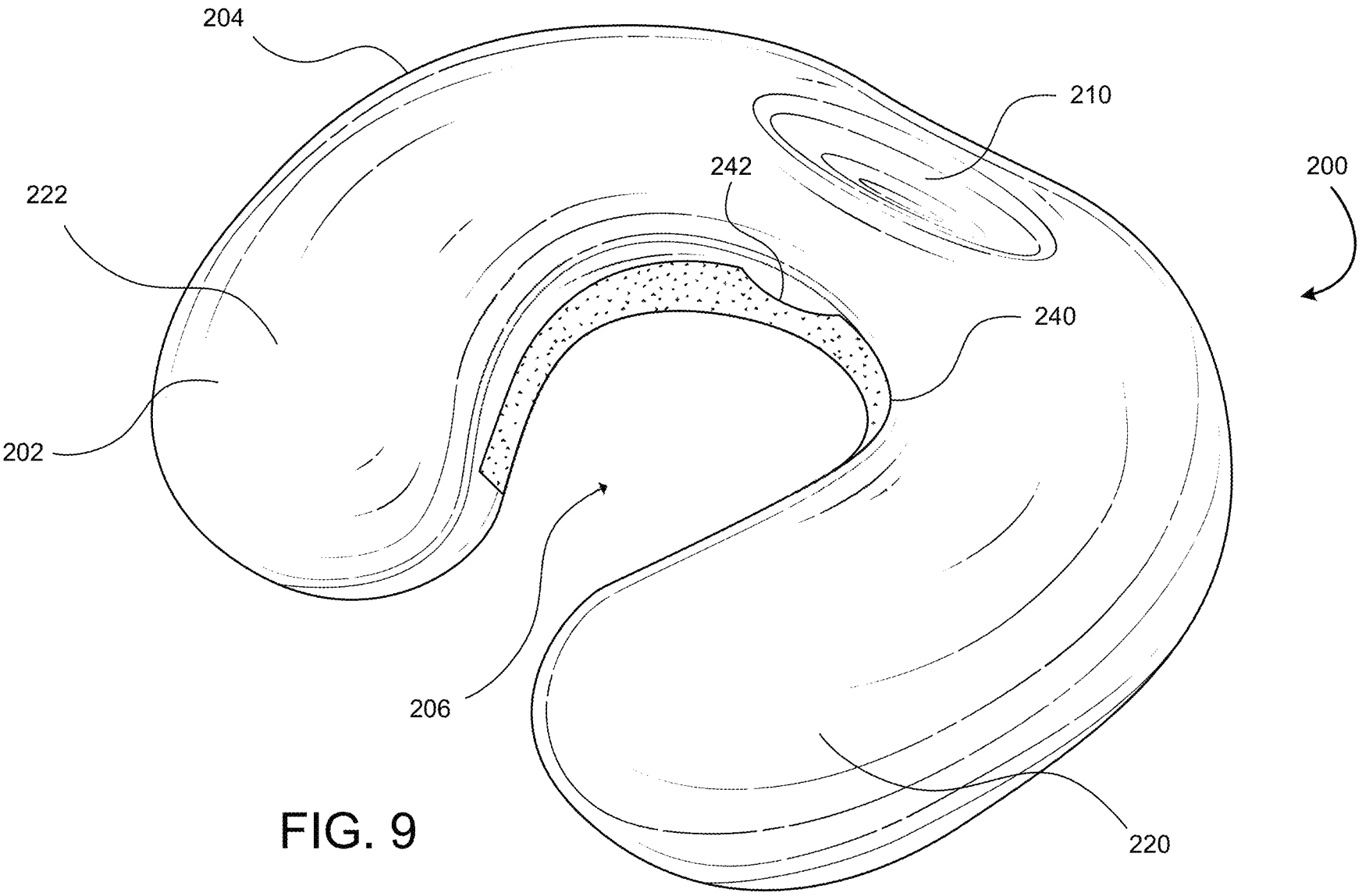
FIG. 9 is a perspective view of an embodiment of a contoured surface support cushion.

Referring to FIGS. 9-10, the cushion cover of the support cushion 200 includes an outer section that extends about the outer perimeter 204 of the cushion 200. The cover includes a seamless inner section 240 that is coupled to the outer section of the cover and that extends about or around the open well 206. The seamless inner section 240 is adapted to prevent tearing of the cover adjacent to the inner portion of the well 206 upon separation of the opposing arms, 220 and 222. The seamless inner section 240 may be a strip or section of material that is sewn to a top piece and a bottom piece of the cover so as to surround the open well 206 along a mid-plane of the support cushion 200. The seamless inner section 240 eliminates a seam that would otherwise run along the mid-plane of the support cushion 200 around the open well 206. The seamless inner section 240 may reinforce the inner section of the cushion 200 around the open well 206 and may provide resiliency that aids in returning the opposing arms, 220 and 222, to a non-deflected shape.

As shown in FIG. 9, the seamless inner section 240 may extend around the open well 206 from near one of the blunt ends of an arm (e.g., 220) to near the blunt end of the other arm (e.g., 222). As more clearly illustrated in FIG. 10, a central portion 242 of the seamless inner section 240 that is positioned in the medial region 210 tapers inward. The inward tapering central portion 242 of the seamless inner section 240 results in the central portion 242 being narrowed between opposing sides of the seamless inner section 240. Stated differently, the central portion 242 is thinner than the opposing sides of the seamless inner section 240. The inward tapering central portion 242 may allow the seamless inner section 240 to be used on the inward tapering medial region 210 of the support cushion 200. For example, the inward tapering central portion 242 may ensure that the seamless inner section 240 is not thicker or larger than the minimum thickness $T_1$ of the cushion body's medial region 210.

In some instances, both an upper surface and a lower surface of the central portion 242 of the seamless inner section 240 taper inward so that the central portion 242 has a roughly hourglass shape. In other embodiments, either the upper surface or the lower surface of the central portion 242 taper inward, but not both surfaces, which results in a more U-shaped or dimpled profile. The remainder of the seamless inner section 240 may have a roughly equal thickness, or taper slightly inward, as the seamless inner section 240 extends to the respective blunt ends of the arms, 220 and 222. A minimum thickness of the central portion 242 may be between 1 and 3 inches, and more commonly between 1 and 2 inches or 1.5 and 2 inches. In some embodiments, a minimum thickness of the central portion 242 may be approximately equal to the minimum thickness $T_1$ of the medial region 210, although it is commonly thinner or narrower than the medial region 210. A length of the central portion 242, as measured from where the central portion begins to taper inward, may be roughly equal to a length of the medial region 210, as measured from where the medial region 210 begins to taper inward. More commonly, however, the length of the central portion 242 is shorter than the length of the medial region 210 when measuring the respective portions as previously described. A thickness of the non-tapering portions of the seamless inner section 240 may be between 1 and 6 inches, and more commonly between 2 and 5 inches or 2 and 4 inches.

Figure 13:
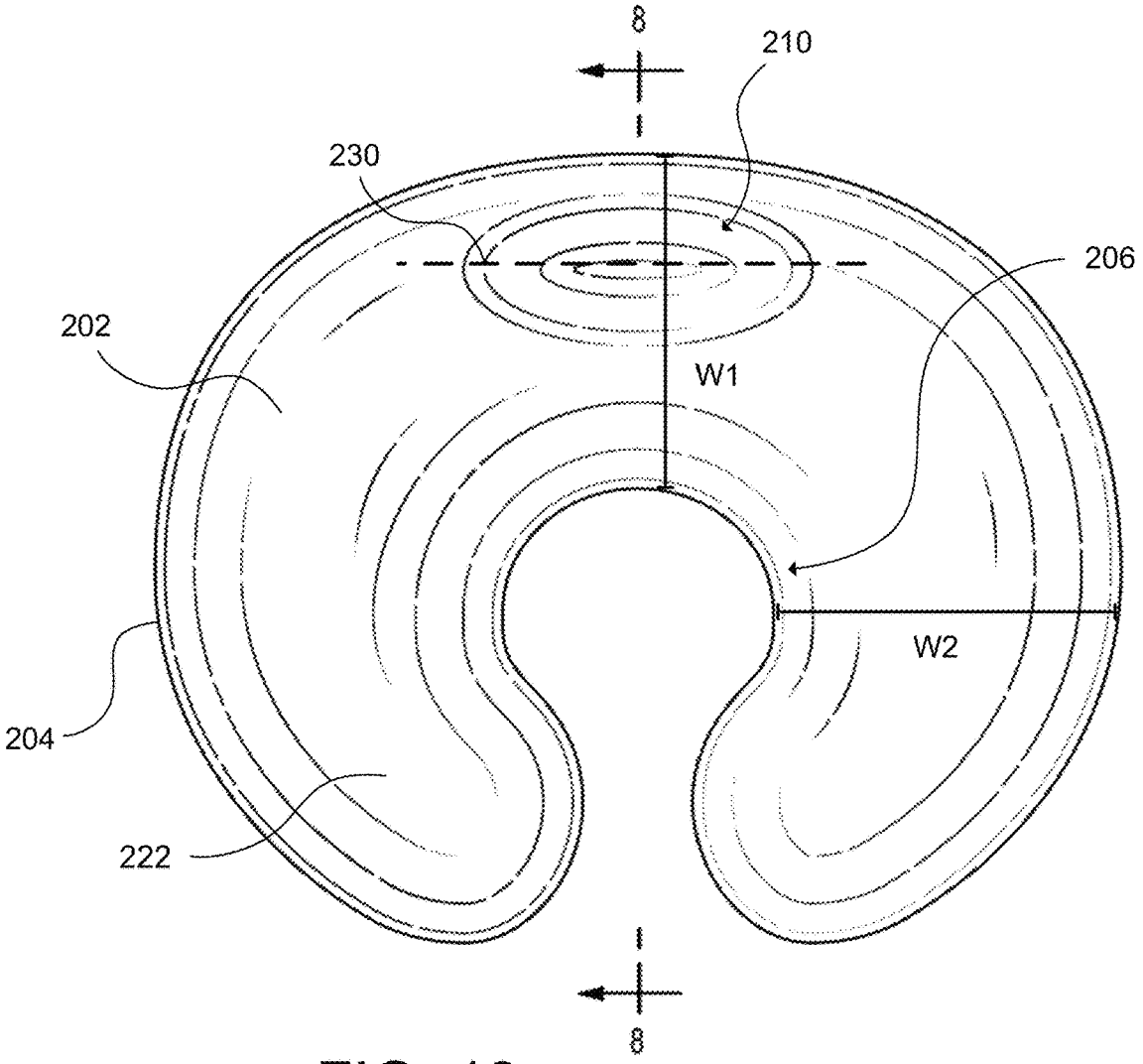
FIG. 13 is a top view of the contoured surface support cushion of FIG. 9.
Figure 14:
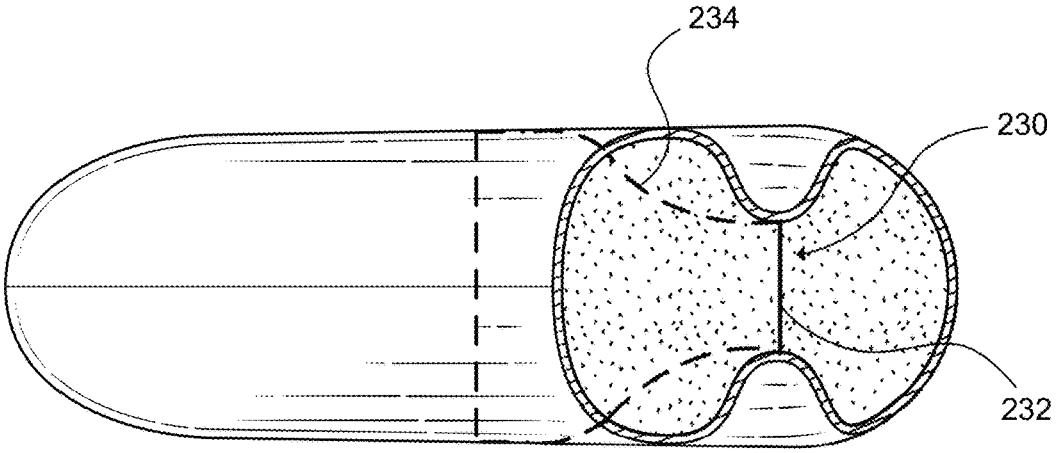
FIG. 14 is a cross-section view of the contoured surface support cushion of FIG. 9.

As shown in FIG. 13, in some embodiments, a width $W_1$ of the medial region 210, as measured in a direction perpendicular to the vertical central axis 207, is roughly equal to a width $W_2$ of a widest portion of each opposing arm, 220 and 222, as measured in a direction perpendicular to the vertical central axis 207. The term "roughly", "generally", "roughly equal", and the like, as used herein, means that the two dimensions are within 70 percent, 80 percent, or 90 percent of each other. Given that the width $W_1$ of the medial region 210 is roughly equal to the width $W_2$ of the opposing arms, 220 and 222, the most prominent deviation between the medial region 210 and opposing arms, 220 and 222, is the inward vertical tapering of the medial region 210.

As briefly described herein, the medial region may have a figure eight or hourglass profile or configuration when viewed from the front (see FIG. 10). When viewed from a different perspective, however, the medial region 210 has a more dimpled, doubly curved, or double torus shape. This shape is illustrated in greater detail in the perspective view of FIG. 9 and in the cross-section view of FIG. 14. The dimpled, doubly curved, or double torus shape is achieved or formed because the support cushion 200 curves inward along a central portion of the cushion body, as shown in the cross-section of FIG. 14. This results in the cross-sectional profile of the cushion body having a figure eight appearance. The inward curve of the central portion of the cushion body may be achieved by coupling a connector or tapering means 230 with an inner surface of the cushion body 202 along the medial region, or forming a connector or tapering means 230 (hereinafter connector 230) on or along the inner surface of the cushion body 202. The connector 230 causes the cushion body 202 to taper inward between the opposing arms, 220 and 222, as described herein. The connector 230 is operably coupled to the two opposing surfaces of the medial region 210, which causes the two opposing surfaces to dip toward each other.

Figure 15A:
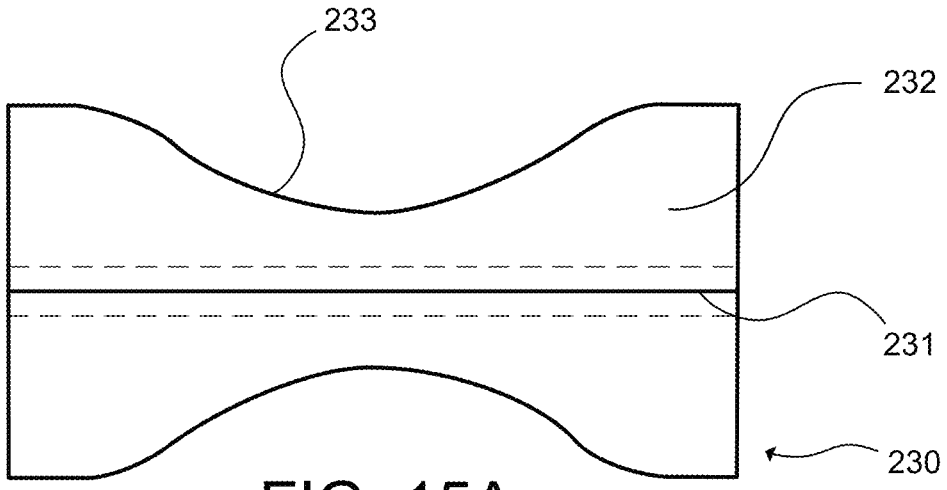
FIGS. 15A-17 illustrate embodiments of a connector or tapering means that may be employed to form or define the contoured surface in the support cushion of FIG. 9.
Figure 15B:
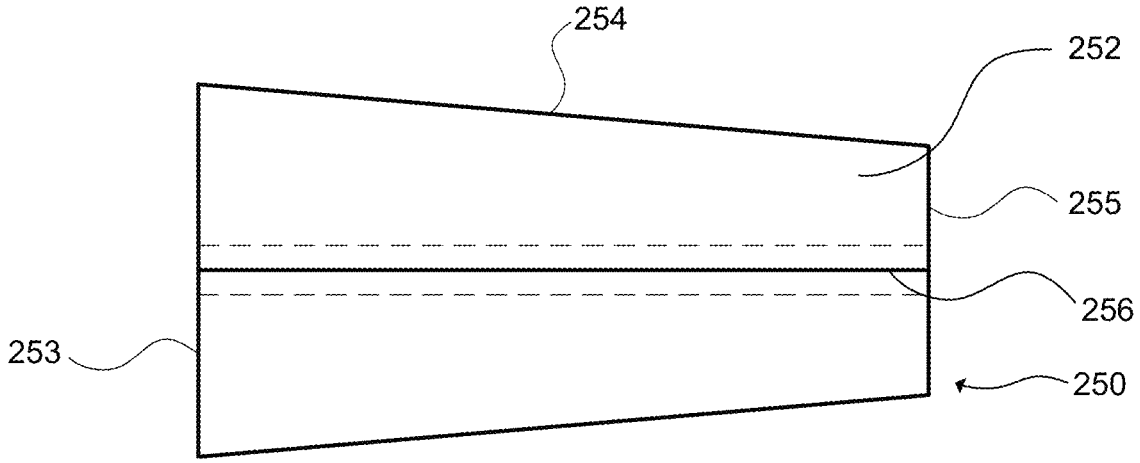
Figure 16:
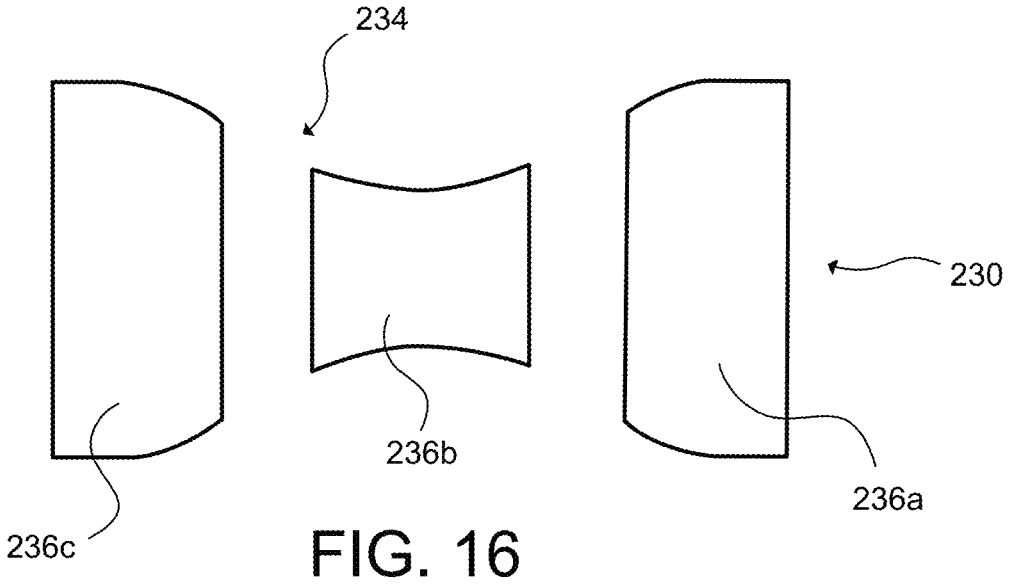
Figure 17:
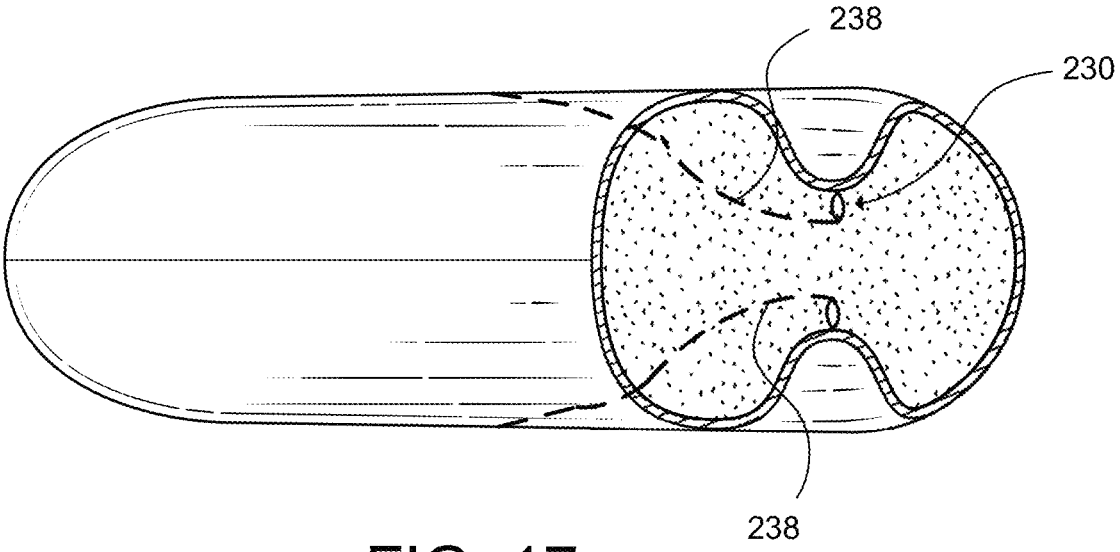

FIGS. 15A-17 illustrate connectors 230 that may be employed to cause the medial region 210 of the cushion body 202 and/or the depression 120 of cushion body 100 to taper inward as described herein. In FIG. 15A, the connector 230 includes or consists of an hourglass shaped material 232, which is commonly a fabric material. The hourglass shaped material 232 has opposing ends and a midsection 233 that narrows or tapers inward between the opposing ends. The midsection 233 typically has a controlled taper or graduation between the opposing ends, although a more abrupt transition between the midsection 233 and ends may be employed as desired. The controlled or smooth graduation of the taper may be preferable to reduce pressure points and achieve a more comfortable and supporting medial region 210. The hourglass shaped material 232 is coupled with the inner surface of the cushion body 202 along the medial region 210 so that the hourglass shaped material 232 forms an inner wall within the cushion body 202. In some embodiments, the hourglass shaped material 232 may be sewn to the top and bottom inner surfaces of the cushion body and then the cushion body may be inverted so that the hourglass shaped material 232 forms the inner wall. The hourglass shaped material 232 may be positioned roughly centrally along the width $W_1$ of the medial region 210 or depression 120, or may be positioned closer to the open well or outer perimeter as desired. The hourglass shaped material 232 is typically positioned within the cushion body to enable a nozzle to be inserted within the cushion body to fill the cushion body with fill material. The hourglass shaped material 232 may have a length of between 5 and 12 inches or longer. The midsection 233 may have a thickness that corresponds with the minimum thickness $T_1$ of the medial region 210 or depression 120 while the opposing ends have a thickness that corresponds with the maximum thickness $T_2$ of the cushion body. In a specific embodiment, the thickness of the midsection 233 and opposing ends may be between 1 and 6 inches. In some embodiments, the hourglass shaped material 232 may have a seam 231 that extends lengthwise along the material and that may be positioned roughly at or near a vertical center of the hourglass shaped material 232.

In FIG. 15B, the connector 250 includes or consists of a trapezoidal shaped material 252, which is commonly a fabric material. The trapezoidal shaped material 252 has a large end 253, a short end 255, and a tapered midsection 254 that extends between the large end 253 and the short end 255. The tapered midsection 254 typically has a controlled taper or graduation between the large end 252 and the short end 255. The controlled or smooth graduation of the taper often mirrors a taper or graduation of the shape of the cushion body, such as between the first end 102 and the second end 104 of the cushion body 100. The trapezoidal shaped material 252 is coupled with the inner surface of the cushion body 100 along the depression 120 so that the trapezoidal shaped material 252 forms an inner wall within the cushion body 100. In some embodiments, the trapezoidal shaped material 252 may be sewn to the top and bottom inner surfaces of the cushion body and then the cushion body may be inverted so that the trapezoidal shaped material 252 forms the inner wall. The trapezoidal shaped material 252 may be positioned roughly centrally along the width $W_1$ of the depression 120, or may be positioned closer to the open well or outer perimeter as desired. The trapezoidal shaped material 252 is typically positioned within the cushion body to enable a nozzle to be inserted within the cushion body to fill the cushion body with fill material. In some embodiments, the trapezoidal shaped material 252 may have a seam 256 that extends lengthwise along the material and that may be positioned roughly at or near a vertical center of the trapezoidal shaped material 252. In other embodiments, the trapezoidal shaped material 252 may be formed of multiple separate material segments or sections similar to those illustrated in FIG. 16.

FIG. 16 illustrates the connector 230 including or consisting of a plurality of separate material segments or sections 234. Specifically, the material segments 234 include opposing ends segments, 236*a* and 236*c*, and a mid-segment 236*b* that is positioned between the end segments, 236*a* and 236*c*. The mid-segment 236*b* is thinner or narrower than the end segments, 236*a* and 236*c*. In some of the embodiments, some of the segments or each of the segments may have a slight taper. For example, in the illustrated embodiment, the end segments, 236*a* and 236*c*, each taper slightly inward while the ends of the mid-segment 236*b* taper outward. In other embodiments, one the segments, or each of the segments, may have rectangular shapes.

The segments, 236*a-c*, are attached to the inner surface of the cushion body 100/202 in a manner similar to the hourglass shaped material 232, but the individual segments,

236*a-c*, are typically separated from each other within the interior of the cushion body 100/202. The material segments 234 function cooperatively within the cushion body 100/202 to define an inner wall that may be similar in shape and function to the inner wall formed by the hourglass shaped material 232. The material segments 234 may be positioned within the cushion body 100/202 in a position and orientation that is similar to the hourglass shaped material 232. For example, the material segments 234 may be positioned along the same plane. In other embodiments, the individual segments may not be positioned along the same plane, which may allow the inner wall of the cushion body 100/202 to curve or bend in a desired manner. In a specific embodiment, the mid-segment 236*b* may have a thickness that corresponds with the minimum thickness $T_1$ of the medial region 210 or depression 120 while the end segments, 236*a* and 236*c*, have a thickness that corresponds with the maximum thickness $T_2$ of the cushion body 100/202. The length of all the material segments 234 may be the same as the hourglass shaped material 232. While FIG. 16 illustrates the material segments 234 including three separate segments, more or fewer segments, 236*a-c*, may be employed in other embodiments as desired.

FIG. 17 illustrates the connector 230 including or consisting of one or more darting segments 238 that are sewn into the inner surface of the cushion body 100/202 along the medial region 210 or depression 120. The darting segments 238 are formed by folding the cushion body 100/202 material inward and stitching or coupling the folded material together. The darting segments 238 may be formed in either the upper surface of the cushion body 100/202, the lower surface of the cushion body 100/202, or along both surfaces of the cushion body 100/202 as illustrated in FIG. 17. Similarly, the darting segments 238 may be formed of a single continuous segment or may be formed of multiple individual segments as desired. The length of each darting segment 238 may be the same as the length of the hourglass shaped material 232.

FIG. 18 illustrates a support cushion 200*a* that is similar to the support cushion illustrated in FIG. 9. A difference between the support cushion of FIG. 9 and the support cushion 200*a* of FIG. 18 is that the cushion may include multiple inward tapering regions and/or the inward tapering medial region 210*a* may be offset from a roughly central position between the blunt ends of the opposing arms, 220*a* and 222*a*. Specifically, as illustrated in FIG. 18, the medial region 210*a* may be offset so that it is not centered about a vertical plane that includes the vertical central axis and divides the cushion into two substantially symmetric halves. Alternatively, or in addition, one of the two opposing arms, 220*a* and 222*a*, or both of the arms may include an inward tapering region, 210*b* and/or 210*c*, as illustrated. The inward tapering region of the opposing arm, or opposing arms, may have a construction and/or configuration as described herein. In some embodiments, the cushion may include a tapering region, 210*b* and/or 210*c*, in one of the opposing arms only and not in the medial region 210*a*. In other embodiments, the cushion may include a tapering region, 210*b* and 210*c*, in both opposing arms, 220*a* and 222*a*, but not in the medial region 210*a*. In yet other embodiments, the cushion may include a tapering region, 210*b* and 210*c*, in both opposing arms, 220*a* and 222*a*, and in the medial region 210*a*, which may be offset as illustrated in FIG. 18 or centrally positioned as shown in FIG. 9. The cushion 200*a* may be configured with any number of tapering regions as desired.

Figure 19:
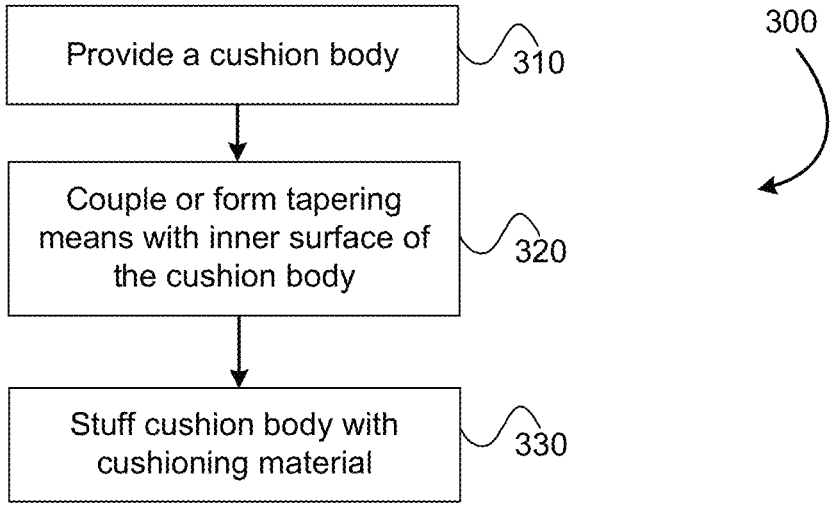
FIG. 19 illustrates a method of forming a contoured surface support cushion.

FIG. 19 illustrates a method 300 of forming a support cushion. At block 310, a cushion body that includes a first end and a second end is provided. The cushion body has a generally arcuate shape between the first end and the second end and defines a vertical axis about which the cushion body curves. At block 320, a connector or tapering means is coupled with, or formed in, an inner surface of the cushion body. The tapering means extends along a majority a length of the cushion body between the first end and the second end. The tapering means may be coupled with the inner surface of the cushion body such that an upper surface and a lower surface of the cushion body taper vertically inward. At block 330, the cushion body is stuffed with cushioning material to form the support cushion. The cushioning material may be stuffed into the cushion body to provide substantially all of the cushion body with a prescribed firmness where a force of at least 10 Newtons applied over at least 30 seconds is required to displace a 3-inch diameter hemispheric probe 1 inch into the cushion body. The cushioning material may be stuffed with various materials including fiberfill, polyester fiberfill, feathers, foam, various other fill materials, and/or combinations thereof. The fill material may be stuffed through an opening that may be closed via a zipper or other mechanical fastener. The zipper may be located on the interior of the cushion body so as to be inaccessible to a user and hidden from view. In some embodiments, the method may also include positioning a decorative cover over the cushion body. The decorative cover may have an opening that enables the cushion body to be inserted within an interior of the decorative covering and removed therefrom.

An alternative method of forming a support cushion includes providing a cushion body that includes a medial region and two opposing arms at block 310. The cushion body may define an outer perimeter and a generally open well. The two opposing arms curve away from the medial region so the cushion body has a roughly toroidal configuration defining a vertical central axis. At block 320, a connector or tapering mean is coupled with, or formed in, an inner surface of the cushion body along the medial region of the cushion body. The medial region may be centrally positioned, or offset from a central positioning, as described herein. A thickness of the medial region, as measured in a direction parallel to the vertical central axis, is thinner, via the connector or tapering means, than a thickness of each opposing arm measured in the direction parallel to the vertical central axis. At block 330, the cushion body is stuffed with cushioning material to form the support cushion. In some embodiments, a connector or tapering means is coupled with, or formed in, an inner surface of an opposing arm or both opposing arms at block 320. This may be done in addition to, or as alternative to, the connector or tapering mean being coupled with, or formed in, an inner surface of the cushion body along the medial region of the cushion body.

The method may also include positioning a cover about the cushion body. In such embodiments, the cover may include an outer section that extends about the outer perimeter and a seamless inner section that is coupled to the outer section and that extends about the open well. The seamless inner section may be adapted to prevent tearing of the cover material adjacent to the inner portion of the well upon separation of the arms. A central portion of the seamless inner section, that is adjacent the medial region of the cushion body, may taper inward so that the central portion of the seamless inner section is thinner than opposing sides of the seamless inner section immediately adjacent to the central portion.

Embodiments of the invention have now been described in detail for purposes of clarity and understanding. However, it will be appreciated that certain changes and modifications may be practiced within the scope of the appended claims.

What is claimed is:

1. A support cushion comprising:

a cushion body comprising a fill material and a cover disposed about the fill material, the cushion body having:

a first end;

a second end;

an outer peripheral edge; and an inner peripheral edge;

wherein the outer peripheral edge and the inner peripheral edge of the cushion body have a generally arcuate shape between the first end and the second end, the cushion body defining a vertical axis about which the outer peripheral edge and the inner peripheral edge curve;

wherein the second end has a width in a direction orthogonal to the vertical axis that is smaller than a width of the first end; and wherein the cushion body tapers inward from both the outer peripheral edge and the inner peripheral edge to define an arcuate depression in the cushion body that extends along a majority of a length of the cushion body between the first end and the second end, wherein the arcuate depression follows a generally arcuate path extending between the first end and the second end of the cushion body; and wherein the generally arcuate path is distanced further from the outer peripheral edge than the inner peripheral edge.

2. The support cushion of claim 1, wherein the first end and the second end are distanced apart by a distance of 15 and 19 inches as measured along a straight line between the first end and the second end.

3. The support cushion of claim 1, wherein the cushion body includes tapering means coupled with, or formed on, an inner surface of the cushion body.

4. The support cushion of claim 3, wherein the tapering means comprises a material that is coupled with the inner surface of the cushion body such that the material forms an inner wall within the cushion body.

5. The support cushion of claim 3, wherein the tapering means comprises one or more darting segments that are sewn into the inner surface of the cushion body.

6. The support cushion of claim 1, wherein the cushion body includes sufficient fill material disposed within the cover to provide the cushion body with a prescribed firmness where a force of at least 10 Newtons applied over at least 30 seconds is required to displace a 3-inch diameter hemispheric probe 1 inch into the cushion body.

7. The support cushion of claim 1, further comprising a decorative cover that is positioned over the cushion body, the decorative cover having an opening that enables the cushion body to be inserted within an interior of the decorative cover and removed therefrom.

8. The support cushion of claim 7, wherein the decorative cover includes a belt that is detachably coupleable with opposing sides of the decorative cover.

9. A support cushion comprising:

a cushion body comprising:

a first end; and a second end, the cushion body having a generally arcuate shape between the first end and the second end and the cushion body defining a vertical axis about which the cushion body curves;

wherein the cushion body tapers inward from both an outer peripheral edge and an inner peripheral edge of the cushion body and defines an arcuate depression in the cushion body that extends along a majority of a length of the cushion body between the first end and the second end, wherein the arcuate depression follows a generally arcuate path extending between the first end and the second end of the cushion body; and wherein the generally arcuate path is distanced further from the outer peripheral edge than the inner peripheral edge.

10. The support cushion of claim 9, wherein an upper surface and a lower surface of the cushion body taper vertically inward such that the cushion body has a figure eight configuration.

11. The support cushion of claim 10, wherein the inward taper of the upper surface and the lower surface provides a gradual transition between a central portion of the cushion body and the first and second ends.

12. The support cushion of claim 9, wherein the cushion body includes tapering means coupled with, or formed on, an inner surface of the cushion body.

13. The support cushion of claim 12, wherein the tapering means comprises a material that is coupled with the inner surface of the cushion body such that the material forms an inner wall within the cushion body.

14. The support cushion of claim 12, wherein the tapering means comprises one or more darting segments that are sewn into the inner surface of the cushion body.

15. The support cushion of claim 9, wherein the cushion body includes sufficient fill material to provide the cushion body with a prescribed firmness where a force of at least 10 Newtons applied over at least 30 seconds is required to displace a 3-inch diameter hemispheric probe 1 inch into the cushion body.

16. The support cushion of claim 9, further comprising a decorative cover that is positioned over the cushion body, the decorative cover having an opening that enables the cushion body to be inserted within an interior of the decorative cover and removed therefrom.

17. The support cushion of claim 16, wherein the decorative cover includes a belt that is detachably coupleable with opposing sides of the decorative cover.

18. A method of forming a support cushion, the method comprising:

providing a cushion body comprising a first end and a second end, the cushion body having a generally arcuate shape between the first end and the second end and the cushion body defining a vertical axis about which the cushion body curves;

coupling or forming tapering means with an inner surface of the cushion body such that the tapering means extends along a majority of a length of the cushion body between the first end and the second end and follow a generally arcuate path extending between the first end and the second end; wherein the generally arcuate path is distanced further from the outer peripheral edge than the inner peripheral edge; and stuffing the cushion body with cushioning material to form the support cushion.

19. The method of claim 18, wherein the tapering means is coupled with the inner surface of the cushion body such that an upper surface and a lower surface of the cushion body taper vertically inward.

20. The method of claim 18, wherein the cushioning material is stuffed into the cushion body to provide the cushion body with a prescribed firmness where a force of at least 10 Newtons applied over at least 30 seconds is required to displace a 3-inch diameter hemispheric probe 1 inch into the cushion body.

21. The method of claim 18, wherein the method further comprises positioning a decorative cover over the cushion body, the decorative cover having an opening that enables the cushion body to be inserted within an interior of the decorative cover and removed therefrom.

* * * * *